US005910162A

United States Patent [19]

Harbour et al.

[11] Patent Number: 5,910,162

[45] Date of Patent: Jun. 8, 1999

[54] PRODUCT MERCHANDISING UNIT WITH VARIABLE/SELECTABLE PRODUCT CAPACITY

[75] Inventors: Keith Harbour, Springfield, Ill.; Christopher C. Bidwell, Dunwoody, Ga.

[73] Assignee: Paul Flum Ideas, Inc., St. Louis, Mo.

[21] Appl. No.: 08/838,992

[22] Filed: Apr. 27, 1997

[51] Int. Cl.[6] ..... A47F 3/04

[52] U.S. Cl. ..... 62/246; 62/372; 62/457.1; 220/629; 312/117

[58] Field of Search ..... 220/529, 625, 220/629; 312/114, 117, 306, 312, 351; 62/246, 371, 372, 457.1

[56] References Cited

U.S. PATENT DOCUMENTS

| | | | |
|---|---|---|---|
| 2,222,160 | 11/1940 | Walsh | 220/529 |
| 3,494,503 | 2/1970 | Kingsley | 312/306 |
| 5,048,305 | 9/1991 | Taub | 62/372 |
| 5,405,043 | 4/1995 | Meloney | 220/529 |
| 5,433,085 | 7/1995 | Rogers | 62/372 |
| 5,458,232 | 10/1995 | Novak et al. | 312/306 |
| 5,564,288 | 10/1996 | Lewis | 62/372 |

FOREIGN PATENT DOCUMENTS

| | | | |
|---|---|---|---|
| 3844552 | 1/1990 | Germany | 220/529 |
| 6794 | of 1912 | United Kingdom | 220/529 |
| 2128591 | 5/1984 | United Kingdom | 220/625 |

*Primary Examiner*—William E. Tapolcai
*Attorney, Agent, or Firm*—Haverstock, Garrett & Roberts

[57] ABSTRACT

A product merchandising display device having variable/selectable product capacity adaptable for use in merchandising both chilled and non-chilled products, the present device including a tub member or receptacle having an internal cavity adapted for receiving and holding a quantity of product, and ice if so desired, and a product support floor member positionable at any one of a plurality of different elevated locations within the tub cavity for varying the product holding capacity thereof. A wide variety of constructions for supporting the product support floor member at the various plurality of different elevations within the tub cavity are disclosed herein, the preferred constructions including at least one shoulder portion located adjacent the tub sidewall at each of the respective elevated locations, the shoulder portions being engageable with at least one peripheral edge portion associated with the product support floor member for supporting the floor member at each of the elevated locations. The floor member is also constructed so as to be maneuverable past any interfering shoulder portions into its substantially flat operative position at each of the plurality of different elevated locations within the tub cavity.

36 Claims, 18 Drawing Sheets

PRODUCT MERCHANDISING UNIT WITH VARIABLE/SELECTABLE PRODUCT CAPACITY

The present invention relates generally to product merchandising display devices for use in storing and displaying for sale products or articles such as bottled or canned soft drink beverages, juices and the like and, more particularly, to various embodiments of a product merchandising display unit adaptable for use in merchandising chilled products wherein such unit includes an internal cavity or receptacle for receiving and holding both a quantity of ice and chilled products positioned therein and a product support structure or floor member which is selectably adjustably positionable at any one of a plurality of different locations within the internal cavity of the unit for varying the product holding capacity thereof. The adjustable product support floor member is particularly advantageous because such floor member can be positioned at the proper elevation within the unit to support a particular quantity of product and ice near the top of the unit for easy access by the customer, and such adjustability also provides for a more attractive display.

In the merchandising of single unit articles such as bottled or canned soft drink and juice type beverages and, particularly, those impulse items which are desired pre-chilled by customers and are normally sold in single units at food counters, points of purchase, and other high customer traffic locations, it is desirable for product display units or containers for merchandising such articles to have a sufficient volume to hold enough product and ice to satisfy periods of high consumer demand, such as on weekends, holidays, and other high consumer traffic periods, yet, at the same time, be adaptable to hold a smaller quantity of such articles and ice for lower sales volume periods. Obviously, if a large capacity container is completely filled with ice and articles for sale during low sales volume periods, the ratio of the amount of ice used to articles sold will be high thereby raising the cost per article sold. If a large capacity container is only partially filled with ice and product for sale during low sales volume periods, the display will not be as attractive and inviting, and the articles positioned therein will be harder to access since they will not be located near the top of the container for easy removal. Conversely, if a container having a volume suitable for lower sales volume periods is stocked with product and used during higher sales volume periods, the container will require more frequent refilling of product.

Another disadvantage to using a container having a product capacity larger than that required for anticipated sales is that, if the container is filled with ice and articles for sale so as to have an initially attractive appearance, as the ice melts the articles will gradually become immersed in cold water. This necessitates reaching into the cold water to retrieve the articles which can be uncomfortable and can cause consumers to select an article for sale from a different, more inviting display. Such an arrangement can also be unattractive depending upon the amount of melted ice within the container. In this regard, germs on customer's hands can be released into the water when customers reach therein to obtain an article.

Various means have been designed to alleviate some of the above-described problems but such means still suffer from certain disadvantages and shortcomings. For example, U.S. Pat. No. 5,433,085 discloses one attempt to achieve a variable capacity container by providing a display container utilizing a float upon which ice and articles for sale can be supported above waste water that collects under the float as the ice melts. A limitation of this device, however, is that no other means are provided for supporting the float at a higher position in the container and if the container is sufficiently large to provide the capacity needed for high sales volume periods, then, if the container is used for lower sales volume periods, the container must be either filled to capacity with articles for sale and ice on top of the float, or such container must be filled with water below the float in order to elevate the float to the extent necessary to raise a smaller amount of product for sale to the top of the container.

Reference also U.S. Pat. No. 5,048,305 which discloses a cooler assembly having a lower sump zone comprised of strut-like spacers which are disposed in an array and provide support to the articles for sale and ice positioned above the waste water while the water collects between the spacers. Shortcomings of this construction include the fact that the spacers are still relatively short and such spacers cannot be raised sufficiently high enough to substantially reduce the container volume. In other words, even with the strut-like spacers, the container volume still remains large. Also, importantly, these strut-like spacers are time consuming and difficult to clean and disinfect.

For these and other reasons, the solutions to the above-described problems addressed by the known prior art have enjoyed only limited success in the marketplace.

SUMMARY OF THE INVENTION

The present invention overcomes many of the shortcomings and limitations of the prior art devices discussed above and teaches the construction and operation of several embodiments of a product merchandising display device adaptable for use in merchandising chilled products having a product support structure selectably positionable therein to enable the unit to hold and display selectable or variable amounts of product for sale along with a desired quantity of ice. The present unit, regardless of the selected capacity, provides an attractive, inviting display in which the articles for sale are made conveniently accessible to the consumer at the top of the unit, and such unit is also easy to restock. In addition, when a smaller product capacity is selected, the unused portion of the present unit beneath the adjustable product support floor member can be utilized as a basin for collecting waste water from the melted ice so that the articles for sale along with the ice are always supported above the waste water level and consumers can access the chilled articles without immersing their hands in cold water. Although the present unit is primarily designed for use in merchandising chilled products, such unit can likewise be equally employed for use in merchandising non-chilled products as well.

The present product merchandising unit comprises a container assembly which includes an outer body member and an inner tub member or other receptacle having an internal cavity associated therewith adapted for receiving and holding beverage products or other articles for sale and a quantity of ice for chilling such products or articles if so desired. Although the outer body member of the present assembly is preferably cylindrical, other container shapes and configurations such as a square, a rectangular and a triangular configuration will likewise work equally as well as will be hereinafter explained. The tub member or other receptacle is typically cooperatively engageable with the upper edge portion of the outer body member, although other means for holding the tub member within the body member may likewise be utilized. The tub member includes an opened upper end portion, a lower or bottom end portion forming the bottom surface of the tub member, and a sidewall extending between the upper and lower end portions thereof defining an internal cavity therebetween. The tub member, in its preferred form, is substantially cylindrical in shape and includes reservoir means formed integral therewith at the bottom portion thereof, the integrally formed reservoir being capable of holding a substantial liquid capacity and further including drain means associated with the lower bottom portion thereof for allowing the melted ice or waste water to escape therefrom. A substantially flat removably adjustable product support floor member or reservoir plate is located immediately above the reservoir portion of the tub member intermediate the top and bottom portions thereof and separates the reservoir from the product holding portion of the tub. The tub member is shaped and sized to fit within the outer body member and, in its preferred embodiment, includes a projecting and downturned rim terminating the top edge of the annular sidewall associated therewith. The projecting downturned rim fits over the top edge of the body member in such a manner that the entire tub member is supported thereby.

To effect changing the interior capacity of the tub member, the floor member is positionable so as to rest upon and/or be supported by any one of a different plurality of spaced steps or shoulder portions located on the interior surface of the tub sidewall intermediate the top and bottom end portions thereof, each plurality of shoulder portions being located at different height levels within the interior cavity of the tub member. In the preferred embodiment, the product support floor member is a planar member, slightly smaller in dimensional expanse as compared to the expanse of the internal cavity of the tub member so as to be readily and easily maneuverable and positionable therein, and includes a plurality of projections or ears which are located and positioned adjacent the peripheral edge portion of the floor member so as to engage and/or rest upon the appropriate plurality of shoulder portions to achieve the desired product capacity. In some embodiments of the present tub member, the different levels of shoulder portions are offset or staggered circumferentially around the inner surface of the tub sidewall and, in other embodiments, the different levels of shoulder portions are vertically spaced and aligned around the tub sidewall. The present shoulder portions or other tub member prominences can be integrally formed as part of the tub inner sidewall, or such shoulder portions can be permanently affixed or detachably attached to the tub sidewall or other support structure by any suitable manner such as by mechanical attachment means, frictional attachment means, adhesives, and other similar means. Although it is preferred that the product support floor member be supported and maintained at the selected locations by the present shoulder portions or other equivalent prominences, it is also recognized that the present product support floor member can be supported and maintained at the various selected locations within the tub member in a wide variety of different ways including, but not limited to, using a plurality of hooks, knobs, buttons or other prominences positioned adjacent the inner tub sidewall adaptable for cooperatively engaging and/or supporting the product support floor member, or using frictional engagement between the product support floor member and the inner sidewall of the tub member. It is also recognized that a product support floor member having a plurality of selectively adjustable telescoping leg portions would likewise achieve the stated objective.

According to another embodiment of the present invention, the present product support structure can include a buoyant float member capable of flotation on melt water or other liquid in the reservoir portion of the tub member, the product support structure also, and importantly, being attachable or cooperatively engageable with at least some of the various shoulder portions or other step members or prominences mentioned above so as to be supported thereon at the various different elevated locations within the tub cavity irrespective of the amount of liquid contained in the tub reservoir. Furthermore, it is likewise contemplated that the product support floor member can be a bowl, dish or other shaped member, and it can be of solid or perforated construction so long as the selected support structure is supportable in the tub cavity at any one or more of a plurality of desired distances from the bottom of the tub member in any of the above-described or similar ways. In this regard, several additional embodiments of a product support structure are disclosed herein wherein the product support structure is fashioned and shaped so as to be operatively positioned within the corresponding tub member in one of at least two different orientations, each orientation yielding a different product capacity.

Regardless of the product support floor member selected, it is desirable that some communication be provided between the display portion of the tub member located above the product support floor member and the reservoir portion located therebelow to allow passage of melt water from the product portion of the tub member to the reservoir. This communication can be achieved through the use of at least one hole or passageway extending through or around the product support structure. Additionally, it is preferred and desired that a single product support member be usable at all elevated locations within the tub member, although it is likewise recognized that different product support members may be used at the different elevations with equal utility. Similarly, it is further recognized that the shape and configuration of the present tub member can likewise take on a wide variety of different sizes and shapes so as to be compatible with the shape of the outer body member.

The present tub member may also include insulation means which is positioned to surround and insulate the bottom and sides of the tub member. Any suitable insulation means such as a foam type insulation may be used to insulate the chilling tub so as to keep the articles placed therein cold for as long as possible. Plastic tubing or other tube means may likewise be connected to the drain means associated with the reservoir portion of the tub member and may be fed through a hole located on one side of the outer body member to the exterior thereof. Clamp means may be positioned on the terminal end portion of the drain tube to control removal of the waste water from the reservoir means, or the drain tube may be connected to a spigot for likewise accomplishing waste water removal. This provides a simple and easy means for emptying the reservoir without having to unload or move the tub member from the overall assembly. The present tub member may likewise be suitably provided with means to accommodate a see-through lid member (not shown) which is designed to rest upon and/or be attached to the upper portion of the tub member. The lid member serves to close the tub member, provides visibility of its contents, and provides ready access to the articles therein by customers. Lid members of various shapes and styles may also be used in conjunction with the present tub members.

OBJECTS OF THE INVENTION

It is therefore a principal object of the present invention to increase the utility of product merchandising and display devices, particularly those devices used to merchandise chilled products.

Another object is to provide merchandising and display devices adaptable for holding varying amounts of product for sale corresponding to varying consumer demand levels.

Another object is to provide a container assembly for conveniently and attractively merchandising chilled products, which assembly always provides product near the top portion of the assembly regardless of the amount of product and ice positioned therein.

Another object is to provide a product merchandising unit which can hold and display a large number of products during high sales volume periods, and which unit can be quickly and easily converted for holding a smaller number of products during lower sales volume periods.

Another object is to provide a merchandising device for chilled products including a tub member having an internal cavity adapted for holding product and ice, which tub member includes a removably adjustable product support floor member positionable therein in spaced relationship between the top and bottom portions of the cavity for supporting products at varying levels above the bottom portion of the tub member.

Another object is to provide a merchandising device for chilled products that allows high visibility of the products stored therein and promotes ready access to such products by customers regardless of the selected product capacity of the unit.

Another object is to provide a product merchandising device having selectable product capacity which is simple and economical to manufacture.

These and other objects and advantages of the present invention will become apparent to those skilled in the art after considering the following detailed specification in conjunction with the accompanying drawings wherein:

DETAILED DESCRIPTION OF THE PREFERRED EMBODIMENTS

For illustration purposes only, the following various embodiments of the present product merchandising display unit including the various present tub members having selectable product capacity used in association therewith are described and disclosed herein as cylindrical shaped members. It is anticipated and recognized, however, that chilled beverage display containers with selectable product capacity constructed according to the teachings of the present invention can likewise be fashioned into a variety of different sizes and shapes as previously explained and that internal components of the present assemblies such as the adjustable floor member may likewise be correspondingly shaped to conform to the shape of the overall assembly without departing from the teachings and practice of the present invention.

Figure 1:
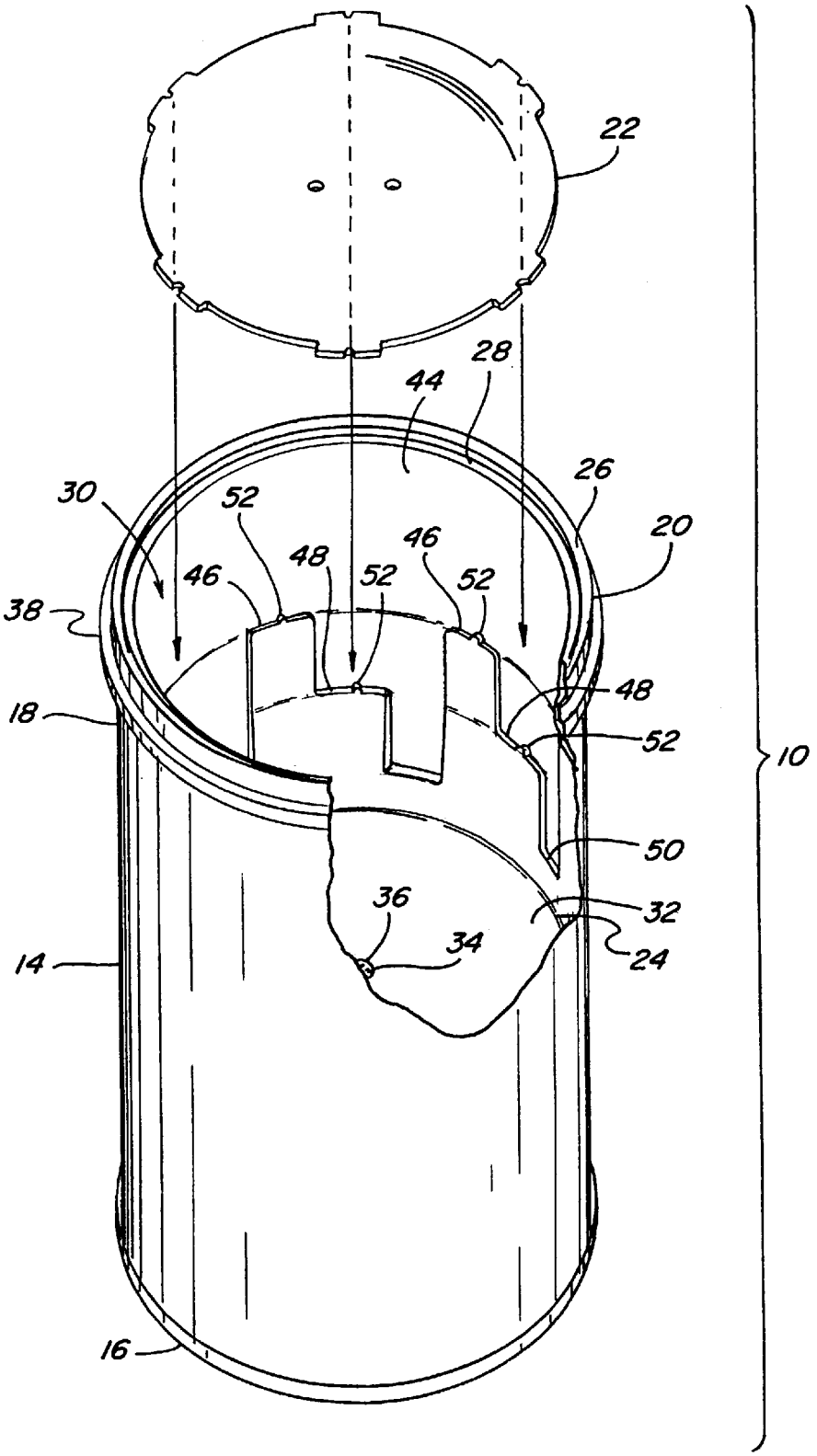
FIG. 1 is a fragmentary perspective view of a product merchandising display unit illustrating one embodiment of the present tub member having selectable product capacity constructed according to the teachings of the present invention, the present tub member being adaptable for holding chilled and non-chilled products, the removably adjustable floor portion being shown in exploded form above the tub member and being insertable therein for selectably varying the capacity thereof.

Referring to the drawings more particularly by reference numbers wherein like numerals refer to like parts, the numeral 10 in FIG. 1 identifies a product merchandising display device constructed according to the teachings of the present invention. The product merchandising device 10 comprises a generally hollow cylindrical shaped outer body member 14 of conventional construction having a lower end portion 16 and an upper edge portion 18, a correspondingly shaped tub member 20 and a separate floor member 22, the tub member 20 including means for selectably positioning the floor member 22 at various elevations within the tub member for adjustably varying the product capacity thereof as will be hereinafter further discussed. The upper edge portion 18 of outer body member 14 cooperatively receives and holds the present tub member 20 as will be likewise hereinafter explained.

Figure 2:
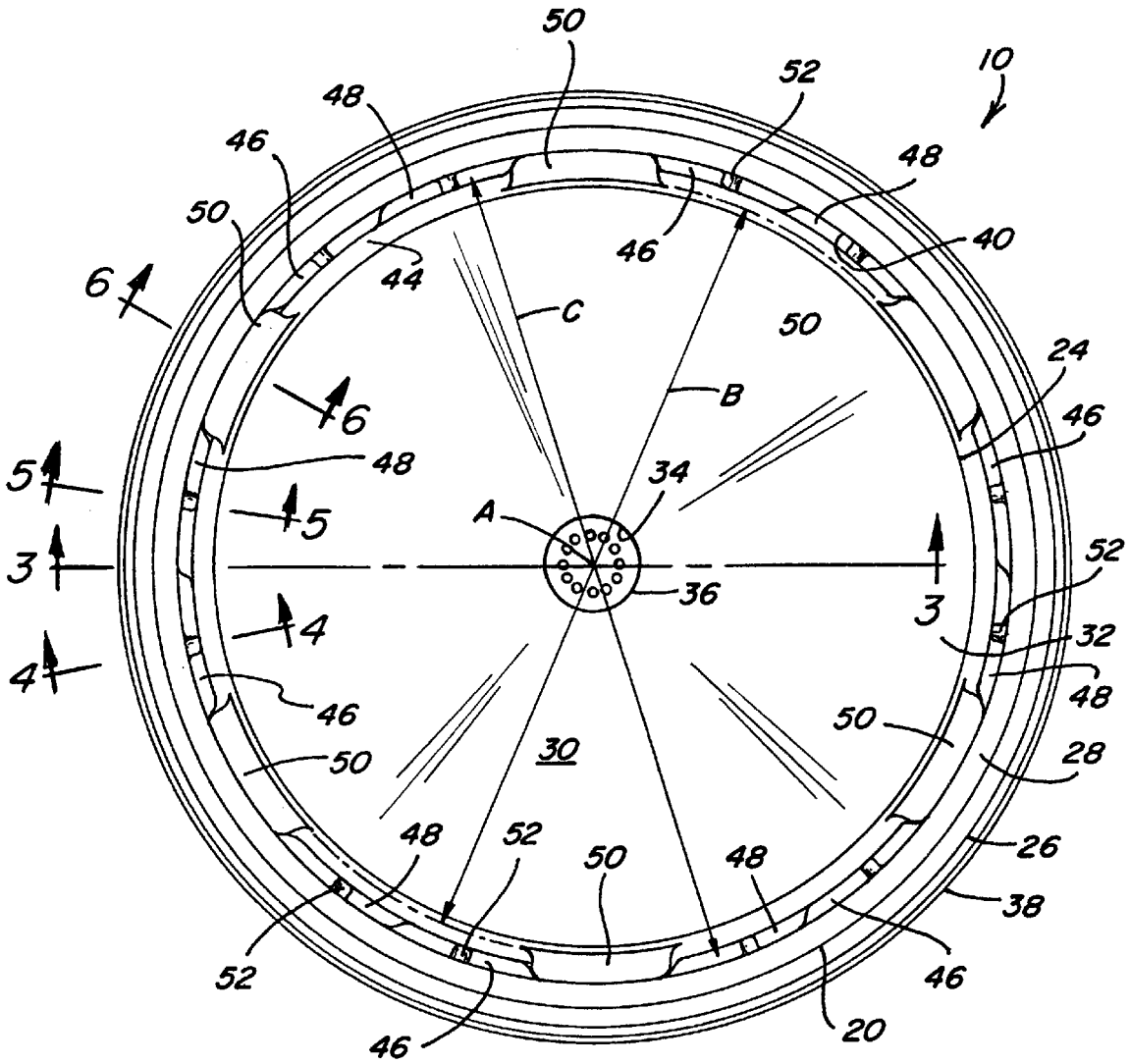
FIG. 2 is an enlarged top plan view of the device of FIG. 1 looking into the tub portion thereof.
Figure 3:
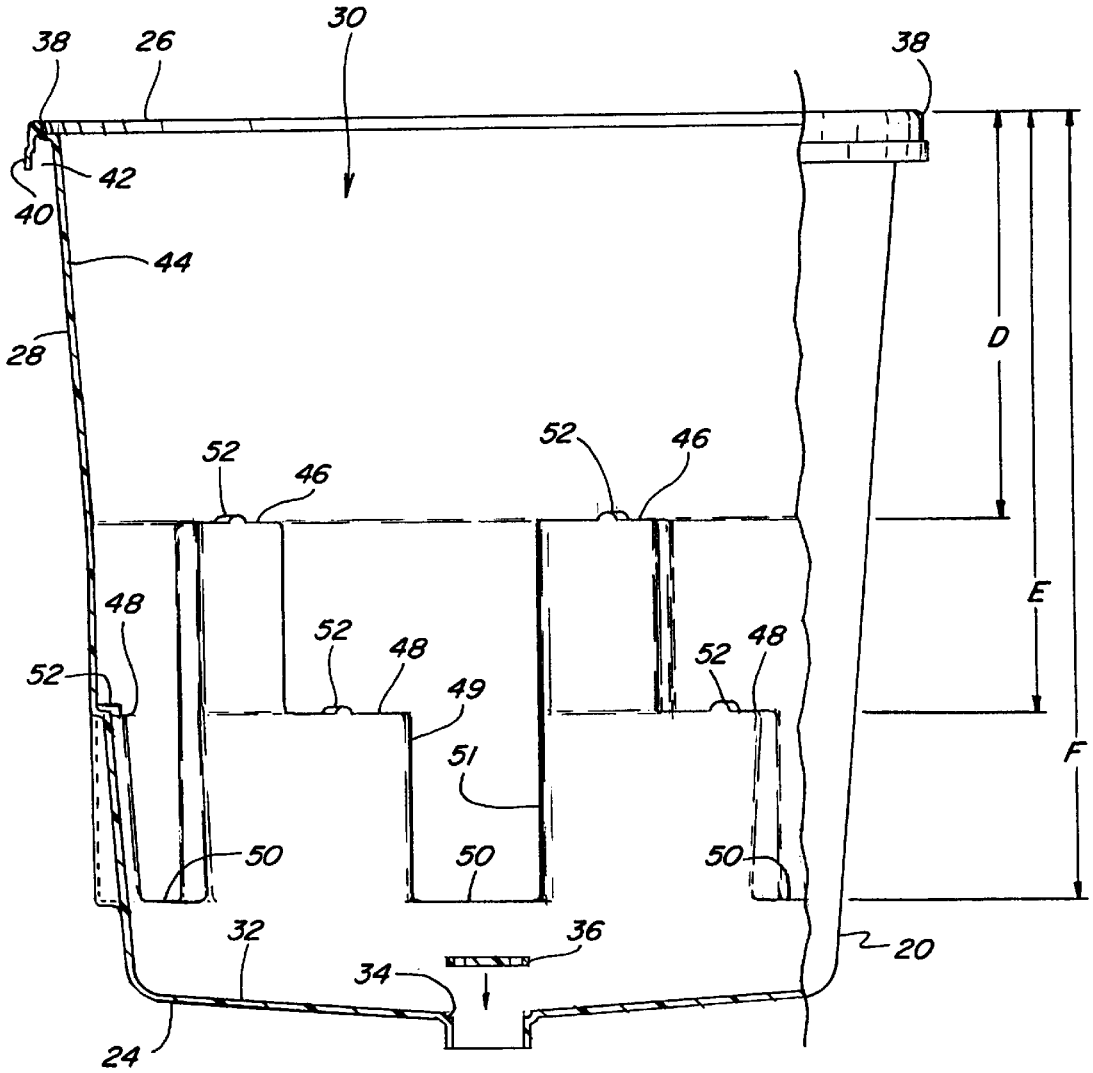
FIG. 3 is a fragmentary cross-sectional view of the tub member associated with the device of FIG. 1 taken along line 3—3 of FIG. 2.

Referring to FIGS. 2 and 3, respectively, the tub member 20 is preferably a one-piece member and includes a lower bottom wall portion 24, an opposite open upper end portion 26, and a continuous sidewall portion 28 extending therebetween defining an internal cavity 30. The lower bottom tub wall portion 24 includes an inner bottom surface 32 which tapers slightly downwardly towards a central drain opening 34 as best shown in FIG. 3 for conducting any liquid from melting ice which may accumulate in the lower portion of cavity 30 to suitable receiving means. The tapered or funneled shape of inner surface 32 towards the center thereof enables any waste water accumulated within the reservoir portion to flow unrestrictedly to the drain opening 34 thereby preventing unwanted trapping of such liquid within the cavity 30. A perforated drain cover 36 is positionable over drain opening 34.

The upper end portion 26 of tub member 20 includes a top rim portion 38 and an annular downturned flange portion 40 extending therearound, the portions 38 and 40 forming an annular outer groove 42 (FIG. 3) adapted to receive the upper edge portion 18 of cylindrical shaped outer body member 14 when the tub member 20 is positioned within the body member 14. The tub member 20 is shaped and dimensioned so as to fit within the outer body member 14 and is suspended therein from the top edge 18 thereof by the rim portions 38 and 40. In this regard, it is important that the top peripheral edge of the body member 14 engage the annular slot 42 formed by the projecting downturned rim portions 38 and 40 so that the tub 20 will be adequately supported when filled with both product and ice. Annular sidewall portion 28 of tub member 20 likewise includes an inner surface 44 extending around internal cavity 30 which tapers slightly inwardly as best shown in FIG. 3 to facilitate molded manufacture thereof such that internal cavity 30 is smaller in cross-sectional dimension adjacent bottom end portion 24 as compared to adjacent upper end portion 26.

Importantly, the annular sidewall 28 of tub member 20 includes a plurality of generally planar upwardly facing shoulder portions or steps 46, 48 and 50 located adjacent inner surface 44 at circumferentially spaced, offset locations around internal cavity 30 as best shown in FIGS. 2 and 3. More particularly, besides each shoulder portion 46, 48 and 50 being offset both laterally and in elevation, each grouping or series of shoulder portions 46, 48 and 50 is likewise circumferentially spaced around the interior portion of tub member 20 as best shown in FIG. 2. Shoulder portions 46, 48, and 50 are important as they are adapted for selectably supporting and positioning the present floor member 22 at three different vertically spaced locations within internal cavity 30 intermediate the bottom wall portion 24 and the upper end portion 26. Referring more particularly to FIG. 2, it can be seen by looking downwardly into the tub cavity 30 that to facilitate interchangeable utilization of floor member 22, the respective shoulder portions 46, 48 and 50 are located at equally spaced intervals around internal cavity 30. Also the shoulder portions 46, 48 and 50 are radially coextensive with respect to the center of the cavity 30, which center is identified by the letter A in FIG. 2. In other words, in the embodiment of FIGS. 2 and 3, the diameter B shown in FIG. 2 represents the minimum distance between any two opposed shoulder portions 46, 48 or 50, and the diameter C (FIG. 2) represents the maximum distance between any two opposed shoulder portions 46, 48 or 50, diameter C being larger than diameter B. It is also recognized that the present shoulder portions may be arranged such that such shoulder portions are not located in opposed relationship to each other. In this situation, the diameter B represents a circumscribed minimum diameter formed by the innermost radial edge portions of any of the shoulder portions 46, 48 or 50, and the diameter C represents a circumscribed maximum diameter formed by the outermost radial edge portions of any of the shoulder portions 46, 48 or 50, the diameter C again being larger than diameter B. The radially coextensive relationship of shoulder portions 46, 48 and 50, along with the relationship between the diameters B and C, are important as they allow for the free passage of floor member 22 within internal cavity 30 at least as far as shoulder portions 50 and the interchangeable engagement of the floor member 22 with any one of the plurality of shoulder portions 46, 48 and 50 as will be hereinafter further explained.

Figure 6:
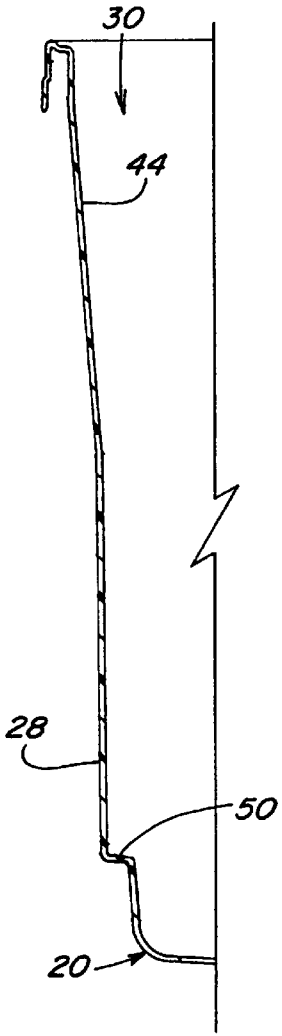
FIGS. 4, 5 and 6 are fragmentary cross-sectional views of the tub member associated with the device of FIG. 1 taken along lines 4—4, 5—5 and 6—6 of FIG. 2 respectively.
Figure 5:
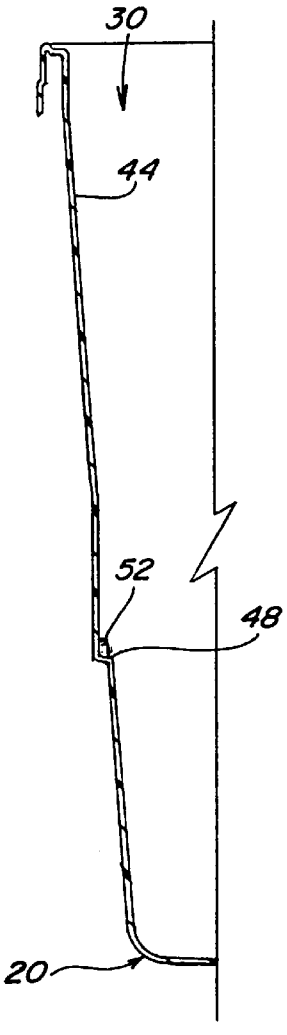
Figure 4:
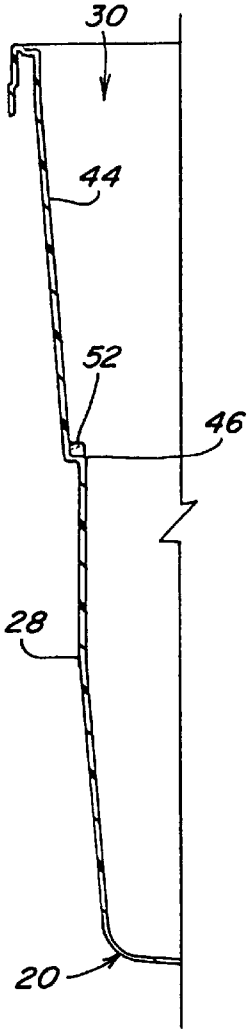

Referring more particularly to FIG. 3, when viewed from the side, shoulder portions 46 are each located at a distance designated by the letter D from the top edge of rim portion 38; shoulder portions 48 are each located at a second distance E from the top edge of rim portion 38; and shoulder portions 50 are each located at a third distance F from the top edge of rim portion 38. It can thus be seen that by selectably engaging floor portion 22 as will be hereinafter explained with the respective shoulder portions 46, 48 and 50, that portion of internal cavity 30 visible from the top, namely, the usable product display volume of tub member 20, can be accordingly varied. The positioning and arrangement of shoulder portions 46, 48 and 50 relative to each other is further illustrated and disclosed in FIGS. 4-6 wherein FIG. 4 is a cross-sectional view of tub member 20 taken through a typical shoulder portion 46 showing the construction of the shoulder 46, including its associated tab portion 52, and the relationship of the shoulder portion 46 to tapered inner surface 44 of sidewall 28 and internal cavity 30; FIG. 5 is a cross-sectional view of tub member 20 taken through a typical shoulder portion 48 showing the construction of the shoulder 48, including its associated tab 52, and the relationship of the shoulder portion 48 to the tapered inner surface 44 of sidewall 28 and internal cavity 30; and FIG. 6 is a cross-sectional view of tub member 20 taken through a typical shoulder portion 50 likewise showing the construction of the shoulder 50 and the relationship of the shoulder portion 50 to the tapered inner surface 44 of sidewall 28 and internal cavity 30.

Figure 7:
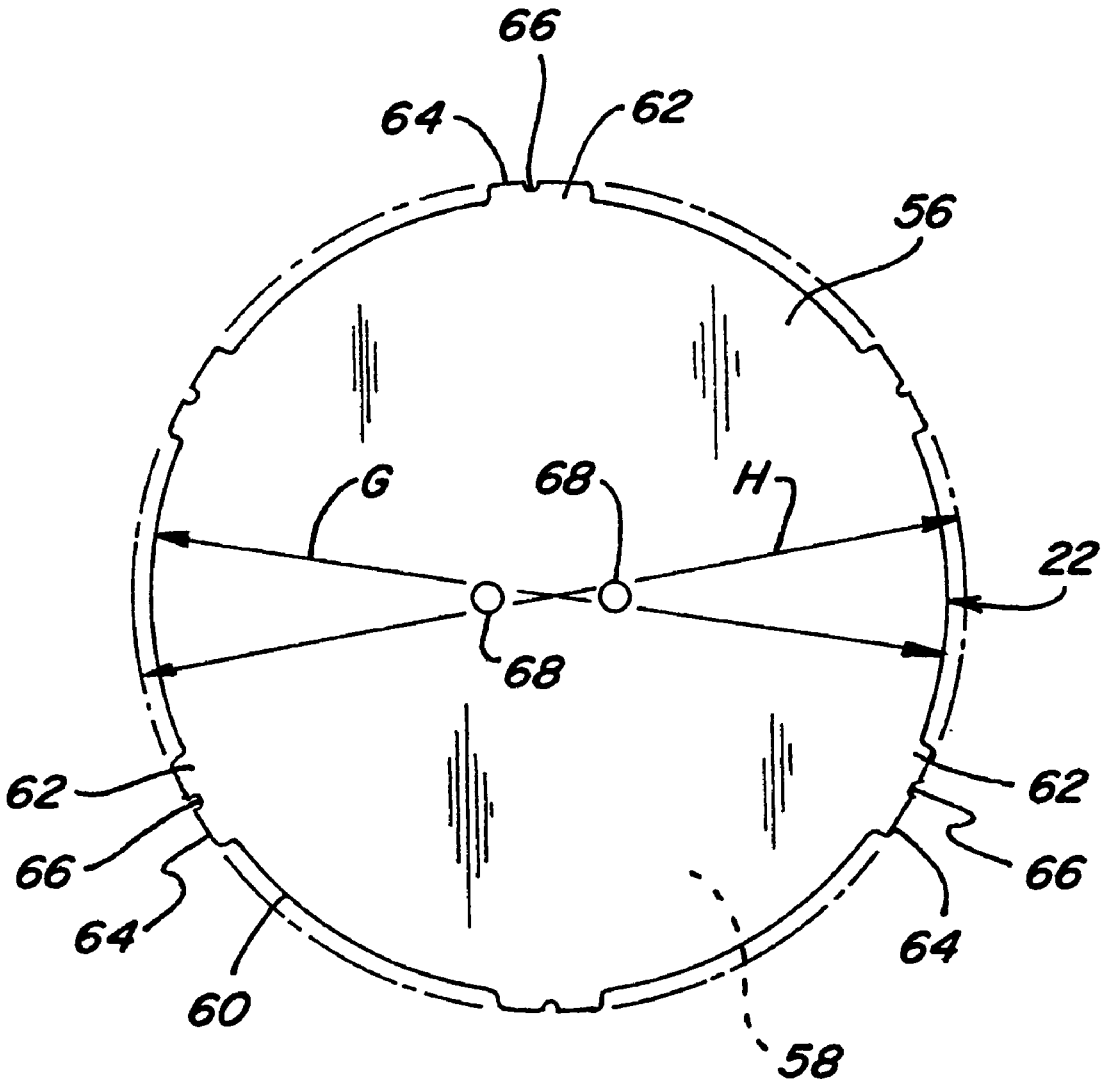
FIG. 7 is a top plan view of the floor member of FIG. 1.

The present removably adjustable floor member 22 is more fully illustrated in FIG. 7 and includes a substantially flat planar member of substantially circular configuration having a top surface 56, an opposite bottom surface 58, and an outer peripheral edge portion 60 having a plurality of circumferentially spaced ears or peripheral edge portions 62 extending radially outwardly therefrom. Outer peripheral edge portions 60 have a maximum diameter designated by the letter G, which diameter is slightly smaller than the minimum diameter B of inner tub surface 44 illustrated in FIG. 2. Likewise, the peripheral edge portions or ears 62 each have outer edge portions 64 which define an imaginary outer diameter identified by the letter H, which diameter H is greater than minimum diameter B but equal to or less than the maximum diameter C associated with the inner tub surface 44 as likewise illustrated in FIG. 2. The relationship of diameter G to diameters B and C and the relationship of diameter H to diameters B and C are important as they provide the necessary clearances between the outer edge portions 60 and 64 of floor member 22 and the inner surface 44 of tub member 20 to enable the selective placement of floor member 22 within the internal cavity 30 and the selective engagement of peripheral floor edge portions 62 with any one of the plurality of shoulder portions 46, 48 and 50 respectively so as to position and support the floor member 22 at a desired vertical location within the tub member. Movement of floor member 22 into engagement with shoulder portions 46, 48 or 50 is easily accomplished by simply angularly rotating floor member 22 so as to align the peripheral edge portions 62 with the appropriate set of shoulder portions 46, 48 or 50, the number of peripheral floor edge portions or ears 62 being equal to the respective number of corresponding shoulder portions 46, 48 and 50. In this regard, although the present tub member 20 is shown as having a plurality of six (6) shoulder portions 46, 48 and 50 respectively for engagement with six peripheral floor ear portions 62, it is recognized and anticipated that any number of corresponding tub shoulder and floor ear portions may be utilized so long as the respective shoulder portions hold and support the floor member 22 within the tub member 20 in a stable position when positioned thereon and product and ice are loaded therein.

When floor member 22 is positioned within internal cavity 30 with a quantity of ice and articles for sale thereon, it is desired for any melt water from the ice to be able to travel around or through the floor member 22 so as to be able to accumulate in the lower portion of the internal cavity. In effect, the floor member 22 divides the tub member 20 into a product holding portion thereabove and a reservoir portion located therebelow. To facilitate removal of the waste water from the product holding portion of the tub 20, floor member 22 has centrally positioned holes 68 located therethrough, which holes 68 can also be utilized for grasping and holding the floor member 22 to install and remove it from the tub cavity 30. Furthermore, diameter G of floor member 22 is sufficiently smaller than both diameters B and C of inner tub surface 44 so that melt water can likewise pass between peripheral floor edge portion 60 and the inner surface 44 of the tub annular sidewall portion 28. Also, importantly, the peripheral space between floor edge portion 60 and edge portions 64 enables the floor member 22 to be maneuvered pass the respective tub shoulder portions 46 and 48 for proper positioning as previously explained.

Figure 8:
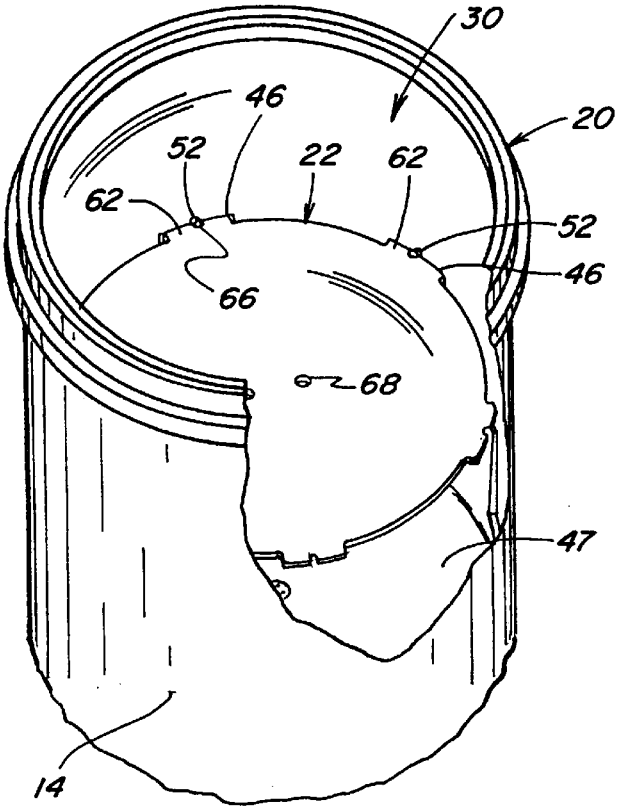
FIG. 8 is a fragmentary perspective view of the device of FIG. 1 showing the present floor member installed in a first selectable position within the tub member of FIGS. 3–6.
Figure 9:
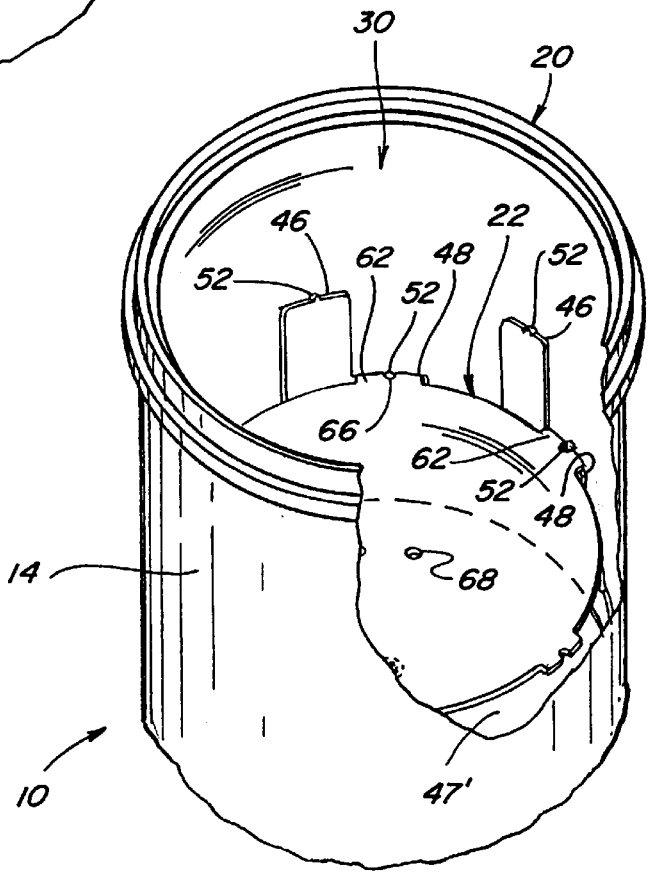
FIG. 9 is a fragmentary perspective view of the device of FIG. 1 showing the present floor member installed in a second selectable position within the tub member of FIGS. 3–6.
Figure 10:
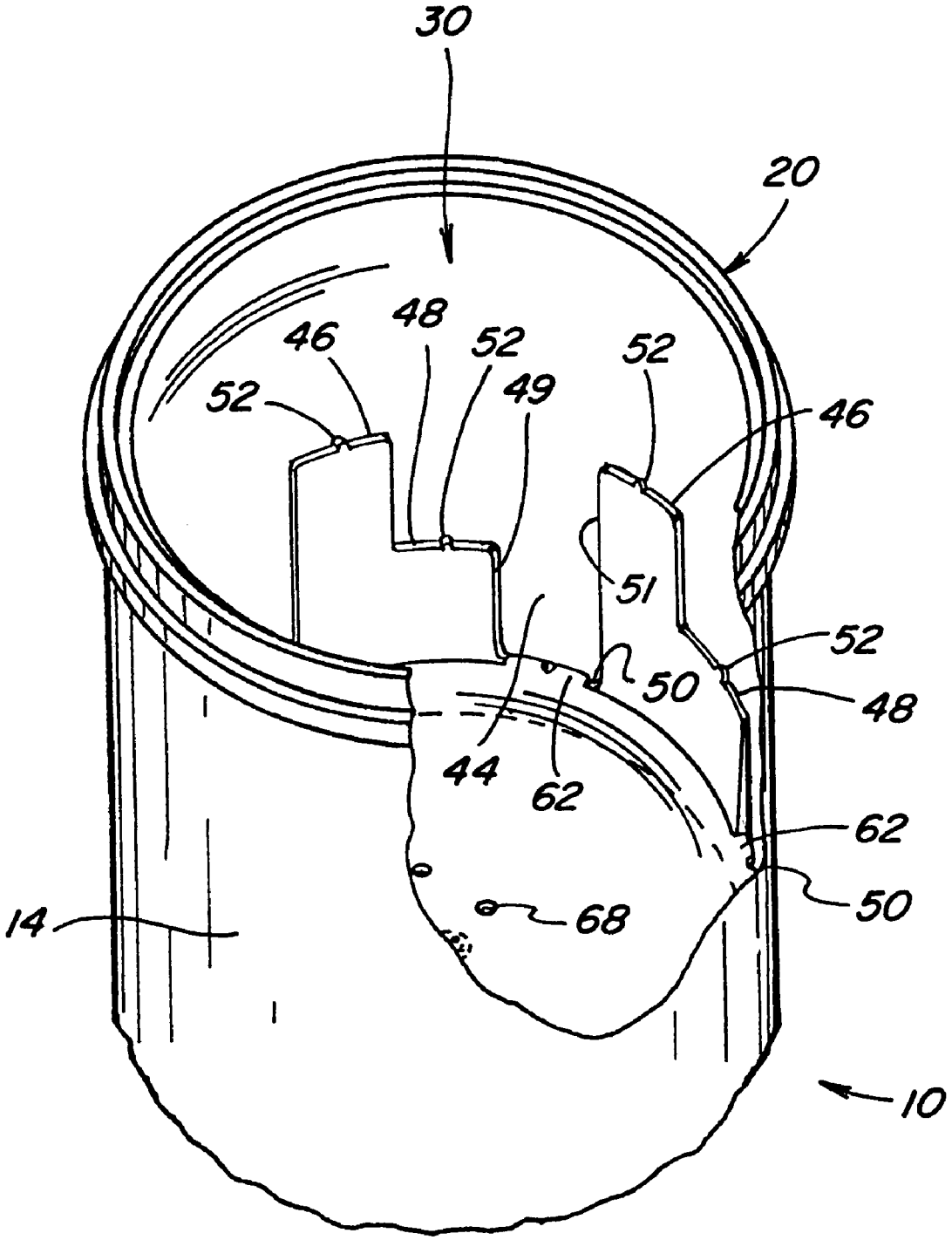
FIG. 10 is a fragmentary perspective view of the device of FIG. 1 showing the present floor member installed in a third selectable position within the tub member of FIGS. 3–6.

FIGS. 8, 9 and 10 show floor member 22 installed within internal cavity 30 of tub member 20 on shoulder portions 46, 48 and 50 respectively. In this regard, shoulder portions 46 and 48 each include an upwardly extending tab portion 52 positioned at a central location thereon as best shown in FIG. 3. Tabs 52 are cooperatively receivable within corresponding notches 66 formed in the respective floor ear portions 62 (FIG. 7) when properly positioned on shoulders 46 and 48 to prevent the floor member 20 from moving laterally and/or rotationally. As can be seen from FIGS. 8 and 9, when floor member 22 is located with peripheral floor edge portions 62 positioned on shoulder portions 46 or 48, the tabs 52 associated with such shoulders are located and received within the notches 66 to prevent lateral or rotational movement of the floor member and resultant accidental disengagement of such member from the respective plurality of shoulder portions. As can be seen from FIGS. 3 and 10, since shoulder portions 50 are recessed into the tub sidewall portion 28, when the peripheral ears 62 of floor member 22 are positioned in engagement with shoulder portions 50, no lateral or rotational movement of the floor member is possible due to shoulder side edge portions 49 and 51. Obviously, when floor member 22 is positioned and located on shoulder portions 46, the portion of tub cavity 30 above the floor member available for receiving and displaying articles for sale including ice is substantially smaller as compared to when the floor member 22 is positioned and located on shoulder portions 48 or 50. Similarly, when the floor member 22 is positioned on shoulder portions 48, the display capacity of tub cavity 30 is likewise smaller as compared to when the floor member is positioned and located on shoulder portions 50. It is also recognized that the display capacity of the tub member 20 can be even further increased by not using the floor member 22 at all. This selectable variable product capacity is an important advantage of the present tub member 20 over devices having a container of a single size, and also over those devices which rely on a float member alone for varying the capacity thereof for all of the reasons set forth above. As best shown in FIGS. 8 and 9, once the floor member 22 is positioned and supported on any one of the plurality of shoulder portions such as the shoulder portions 46 (FIG. 8) or 48 (FIG. 9), a reservoir portion for collecting waste water is formed therebelow such as the reservoirs 47 and 47' illustrated in FIGS. 8 and 9.

Although shoulder portions 46, 48 and 50 are each disclosed as a plurality of laterally segmented arcuate shoulder portions, it is further recognized and anticipated that the lateral or circumferential length of each respective shoulder portion could be increased or decreased, and it is recognized that a single shoulder portion 46, 48 or 50 could be utilized at each vertically spaced location within the cavity 30, each such single shoulder portion extending a sufficient lateral or circumferential distance around the inner portion 44 of tub sidewall 28 so as to provide adequate support for and stability to the floor member 22 when positioned thereon. In this situation, the floor member 22 must be sufficiently sized and shaped so as to be maneuverable into its substantially flat product support position at each such spaced location within the tub cavity 30. This could include leaving a sufficient space or gap between the respective end portions of such single shoulder portion such that the floor member 22 could be maneuvered past such shoulder portion by positioning such floor member on end and thereafter inserting the same at least partially through the space or gap formed between the opposed end portions thereof. Other orientations and configurations of both the shoulder portions 46, 48 and 50 as well as floor member 22 are likewise possible to effect the proper positioning of the floor member 22 relative to the shoulder portions 46, 48 and 50.

Figure 11:
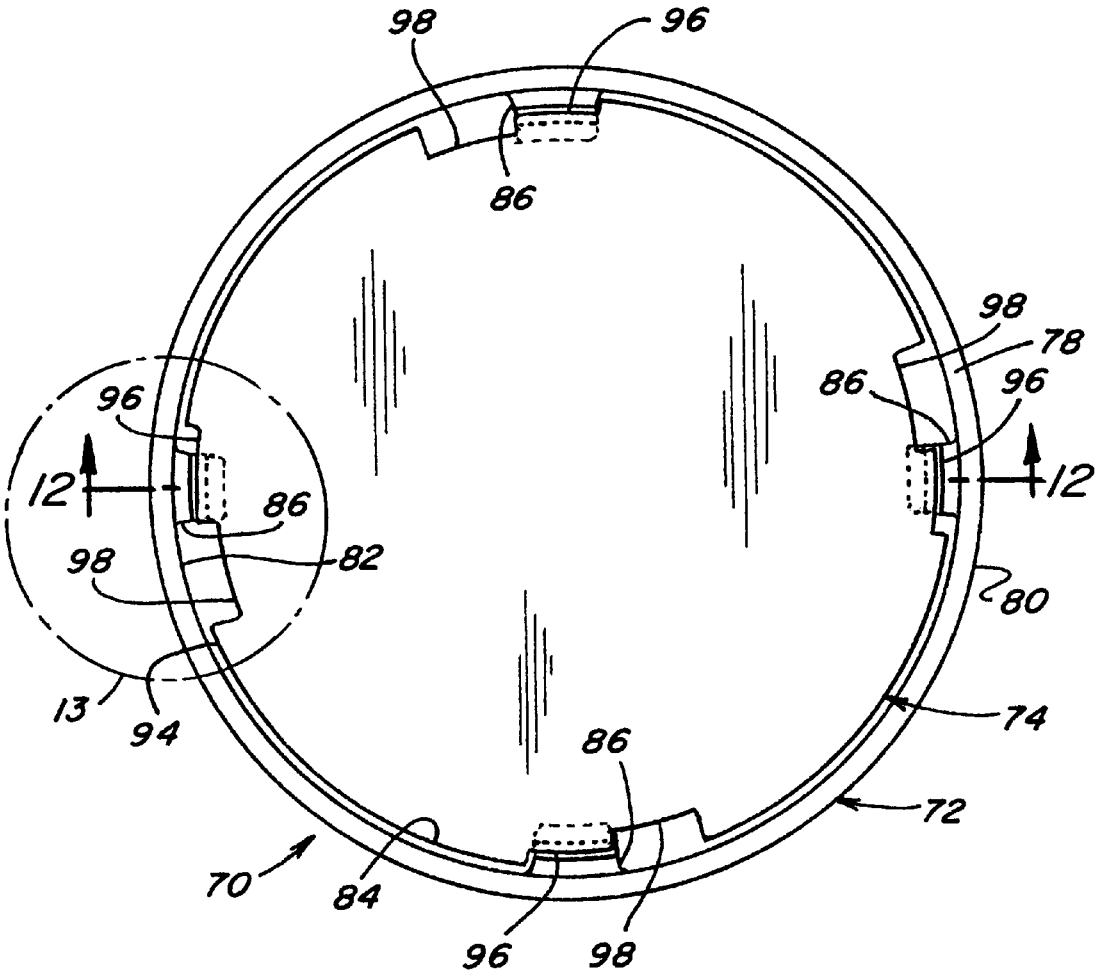
FIG. 11 is a top plan view of another embodiment of a tub member and corresponding floor member having selectable product capacity constructed according to the teachings of the present invention.
Figure 12:
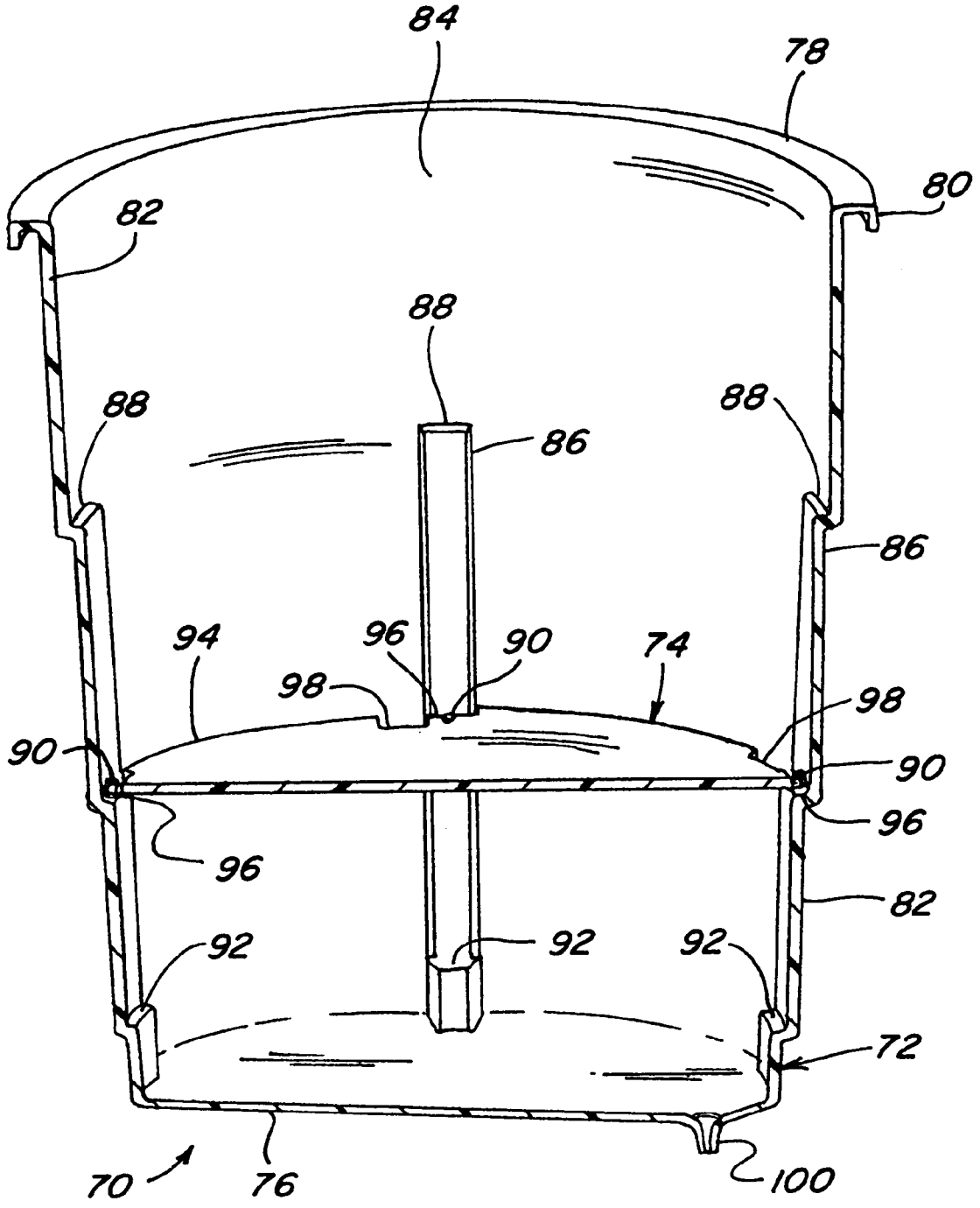
FIG. 12 is a cross-sectional perspective view of the device of FIG. 11 taken along line 12—12 of FIG. 11.
Figure 13:
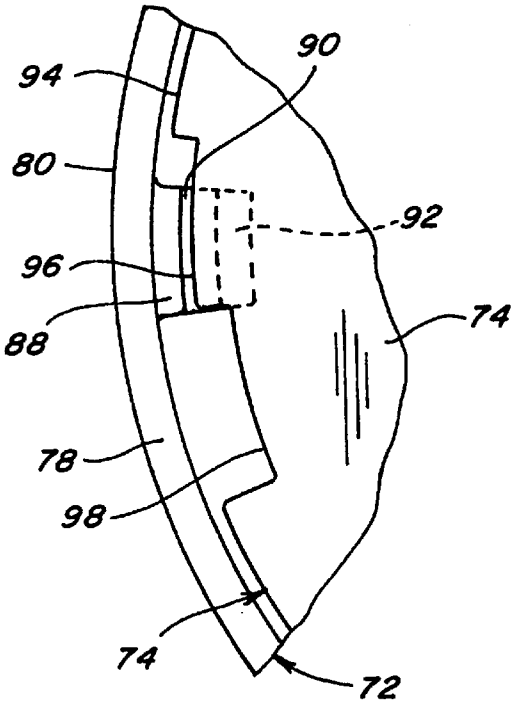
FIG. 13 is a fragmentary enlarged top plan view of the device of FIG. 11 showing in more detail the positioning of the product support floor member relative to the one of the shoulder portions of the associated tub member.

FIGS. 11, 12 and 13 illustrate another embodiment 70 of a chilled beverage display container assembly having selectable product capacity adapted for use in association with an outer body member such as the body member 14 discussed above. The container assembly 70 includes a tub member 72 and a separate product support floor member 74. The tub member 72 is a cylindrical shaped member having an enclosed bottom end portion 76 (FIG. 12), an opposite open top end portion 78 including an annular downturned flange 80 extending therearound, and a continuous sidewall 82 extending between bottom and top end portions 76 and 78 forming an internal cavity 84. Sidewall portion 82 includes a plurality of longitudinally extending ribs 86 projecting a short distance inwardly into the cavity 84 at circumferentially spaced locations therearound, each rib 86 including a plurality of longitudinally spaced steps or shoulder portions 88, 90 and 92 as best shown in FIG. 12. Shoulder portions 88, 90 and 92 are located along each respective rib 86 in progressively closer proximity to bottom end portion 76 and such shoulder portions are also progressively closer radially to the longitudinal center of internal cavity 84 as shown.

Product support floor member 74 is a substantially flat planar member corresponding generally in shape to the circular shape of internal cavity 84, but being slightly smaller in overall diameter as compared to the diameter of cavity 84 located immediately above shoulder portion 92. The floor member 74 further includes outermost peripheral edge portions 94 appropriately dimensioned so as to cooperatively engage shoulder portions 88 when properly positioned and rotated within cavity 84 to position and support the floor member 74 at a first longitudinal location within the tub cavity 84 (not shown). The floor member 74 also further includes a plurality of adjacent cutouts defining peripheral edge portions 96 and 98 located radially inwardly from outermost edge portions 94 at circumferentially spaced intervals around the tub member 72 corresponding to the angular spacing of rib members 86 as best shown in FIG. 11. The peripheral edge portions 96 and 98 are likewise appropriately dimensioned to cooperatively engage shoulder portions 90 and 92 respectively so as to enable the product support floor member 74 to be positioned and supported at two additional longitudinal locations correspondingly deeper within the tub cavity 84 such as shown, for example, by the engagement of edge portions 96 with shoulder portions 90 in FIGS. 12 and 13. In this regard, the cutouts defining edge portions 96 are dimensioned to clear shoulder portions 88 and the cutouts defining edge portions 98 are dimensioned to clear shoulder portions 88 and 90 when such cutouts are respectively aligned with the rib members 86. The capacity of container assembly 70 can therefore be varied similarly to display container 10 to provide the same advantages thereof. Movement of floor member 74 into engagement with the respective shoulder portions 88, 90 and 92 is likewise easily accomplished by simply angularly rotating floor member 74 so as to align the appropriate peripheral edge portions 94, 96 or 98 with the appropriate corresponding set of shoulder portions 88, 90 or 92.

Tub member 72 additionally includes a drain nipple 100 located on the bottom wall portion 76, which nipple 100 can be connected to a valve, spigot or other suitable member (not shown) for enabling waste water which accumulates below the floor member 74 to be removed from the lower portion of the tub member 72. In this regard, although waste water may easily drain from above floor member 74 to the reservoir area therebelow through the various cutouts forming peripheral edge portions 96 and 98, the member 74 may also include drain holes (not shown) similar to the holes 68 associated with floor member 22 to further facilitate this effort.

Although the tub member 72 illustrated in FIG. 12 is shown as having an inwardly tapered annular sidewall 82, it is recognized that the sidewall 82 can likewise be formed with no taper, or such sidewall can include a plurality of tapers, or even recessed portions such as the recessed portions associated with shoulder portions 50 of tub member 20 (FIG. 3). Regardless of the configuration of the sidewall selected for tub member 72, the shoulder portions 88, 90 and 92 can be appropriately dimensioned so as to ensure engagement with the appropriate peripheral edge portions of the floor member 74 to properly position and secure such floor member at the appropriate level within the tub member 72. Also, it is recognized and anticipated that the cutouts defining the peripheral edge portions 96 and 98 can likewise be circumferentially spaced around the outside periphery of the floor member 74 such that each plurality of edge portions 96 and 98 respectively are positioned and located so as to engage the appropriate plurality of shoulder portions 90 and 92 respectively. It is further recognized and anticipated that any number of shoulder portions such as the shoulder portions 88, 90 and 92 may be positioned and located longitudinally on the respective ribs 86 and the floor member 74 may include any number of corresponding cutouts to cooperatively engage each plurality of such shoulder portions. Still further, it is also recognized and anticipated that a floor member similar to floor member 22 having a plurality of peripheral projections or ears such as the peripheral portions 62 (FIG. 7) can likewise be appropriately fashioned and dimensioned so as to be compatible for use with tub member 72.

Figure 14:
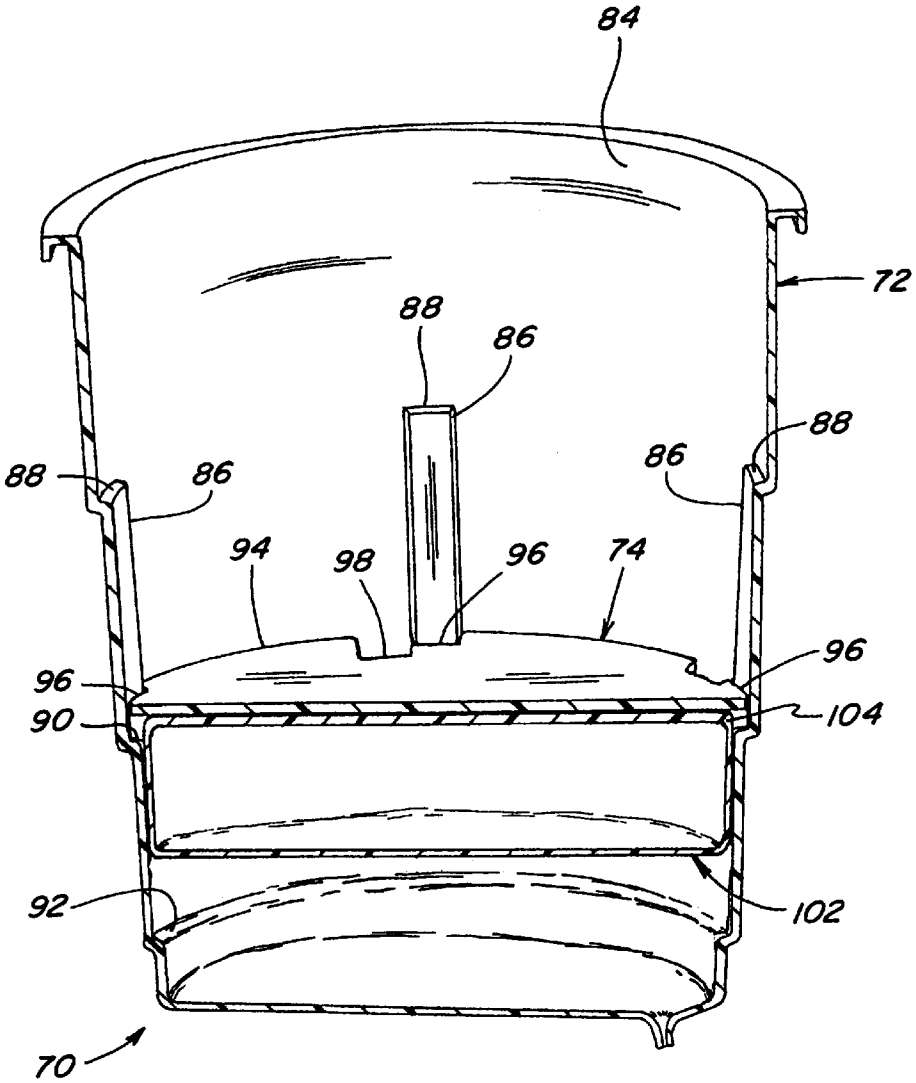
FIG. 14 is a cross-sectional perspective view of the device of FIG. 12 illustrating use of an alternative buoyant product support floor member therein.

FIG. 14 shows an alternative product support assembly 102 which is likewise usable with tub member 72 as described above. Product support member 102 is a buoyant assembly which includes a planar upper product support floor member such as the floor member 74 previously described including peripheral edge portions 94, 96 and 98 extending therearound, and a lower float member 104 positioned below member 74 as shown in FIG. 14. The float member 104 can be a hollow member as shown, or such member can be constructed of a foam material (not shown), so long as the float 104 has sufficient buoyancy characteristics to allow the entire assembly 102 to float on the water or other liquid that accumulates in the lower portion of tub member 72 while supporting a desired quantity of product and ice. In this regard, float member 104 can take on any size and/or shape and such member can be a separate member merely positioned beneath product support floor member 74, or member 104 can be suitably removably or permanently attached thereto. Alternatively, the members 74 and 104 can be integrally formed into a one piece construction. When floating on water or other liquid in the tub member, the assembly 102 will rise and fall within cavity 84 in accordance with the liquid level therein and rib members 86 will act to guide and maintain the assembly 102 in the general orientation shown.

The embodiment illustrated in FIG. 14 is particularly advantageous when it is necessary to raise the product support floor member 74 towards the upper portion of the tub member 72 during low sales volume periods, such as raising the floor member 74 to the level of shoulder portions 88. Instead of filling the tub member 72 with a sufficient amount of water to raise the floor member to the level of shoulder portions 88, the entire assembly 102 can be raised and the floor member 74 can be positioned and supported on the plurality of shoulder portions 88 as previously described with respect to FIGS. 11–13. This arrangement obviates the need for filling the tub member 72 with a sufficient amount of water to elevate the assembly 102 to the extent necessary to raise a small amount of product for sale to the top of the tub member. In this regard, it is recognized and anticipated that any number of shoulder portions 88, 90 and 92 may be longitudinally positioned on each rib member 86 to provide more selectability with respect to product capacity, and the rib members 88 may be extended longitudinally so as to terminate closer to the top edge portion of the tub member 72. This extension of the rib members 86 will not only provide space for the addition of more shoulder portions, but such extended rib members will likewise guide and maintain the assembly 102 in its general operative orientation closer to the top edge portion of the tub members 72 during flotation. This is an improvement over the flotation embodiment disclosed in U.S. Pat. No. 5,433,085.

When buoyancy is not required or desired, peripheral edge portions 94, 96 and 98 of floor member 74 are again selectably cooperatively engageable with shoulder portions 88, 90, and 92 as previously described above with respect to FIGS. 11–13 and the product support assembly 102 can be selectably positioned and supported at a desired fixed location within internal cavity 84. In this regard, in the embodiment shown in FIG. 14, the lower float member 104 is removable from upper product support floor member 74 to allow engagement of peripheral edge portions 96 and 98 with their respective shoulder portions 90 and 92 as previously explained.

Figure 15:
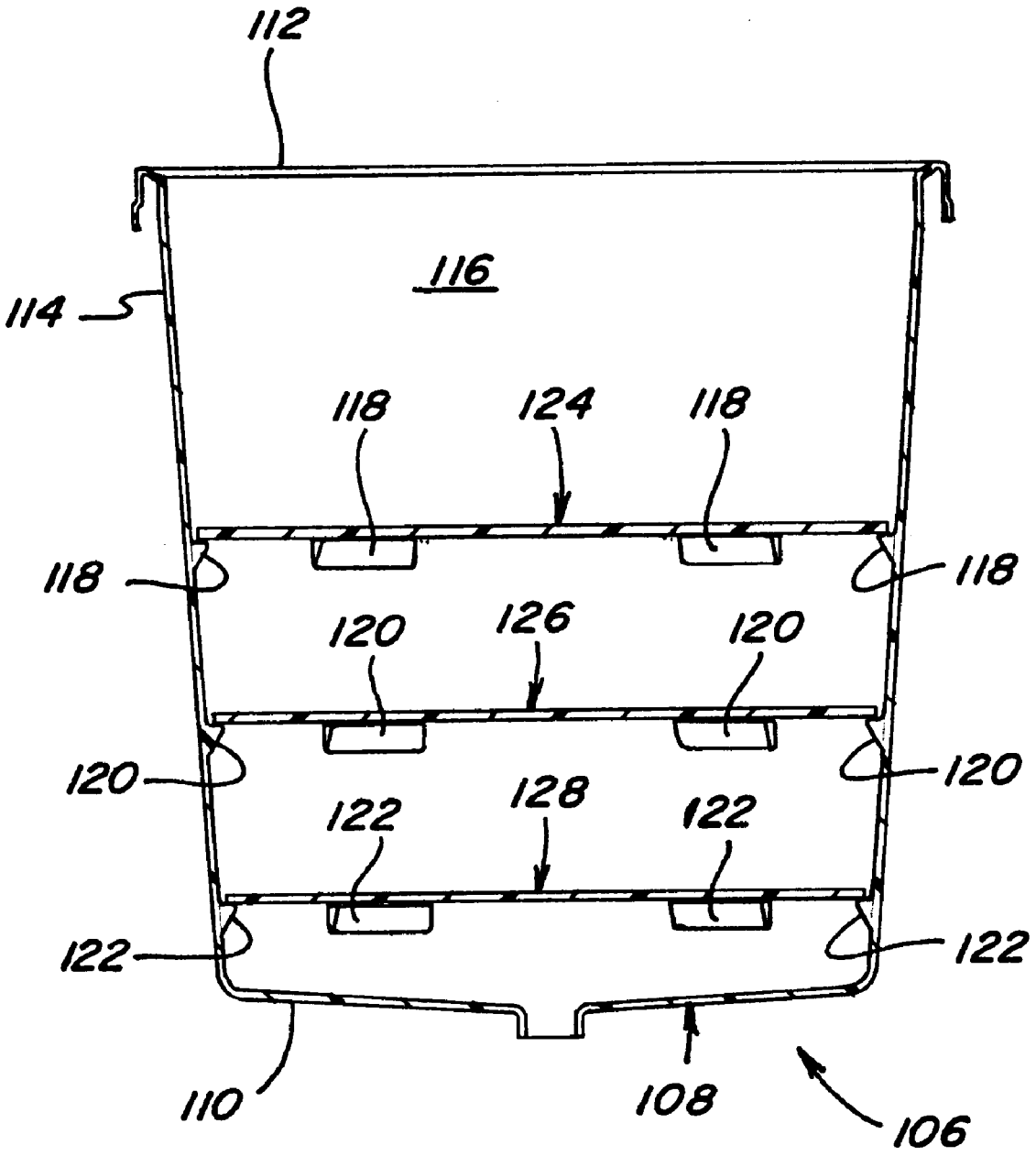
FIG. 15 is a cross-sectional view of still another embodiment of the present tub member constructed according to the teachings of the present invention showing floor members positioned at various elevations within the receptacle.

Referring to FIG. 15, still another embodiment 106 of a chilled beverage display container assembly having selectable product capacity is illustrated. Like the previously described embodiments, container 106 is adapted for use in association with an outer body member such as body member 14 illustrated in FIGS. 1 and 8–10. Embodiment 106 includes a tub shaped member 108 having a bottom wall portion 110, an opposed open top end portion 112, and a slightly tapered sidewall portion 114 extending therebetween defining an internal cavity 116. Tub member 108 includes a plurality of inwardly extending shoulder portions 118, 120 and 122 located on sidewall portion 1 14 at different respective locations between the top and bottom end portions 112 and 110 respectively as shown in FIG. 15. Shoulder portions 118, 120 and 122 are likewise located at circumferentially spaced locations around inner cavity 1 16 and such shoulder portions can be either longitudinally aligned as shown in FIG. 15, or they can be arranged in an offset or staggered pattern in any desired relationship such as the offset arrangement illustrated in FIG. 3. With the aligned arrangement illustrated in FIG. 15, three separate floor members may be used, each floor member being dimensioned to engage a particular plurality of shoulder portions at a particular elevation within the tub member 108, each such floor member being likewise dimensioned to be inserted within the tub member 108 so as to clear any shoulder portions which may lie above the particular level of shoulder portions for which that particular floor member was specifically designed to rest upon. For example, a first circular, planar floor member 124 having a diameter slightly smaller than the diameter of the tub member 108 located in the proximity of shoulder portions 118 is insertable into the cavity 116 and is positionable on shoulder portions 118 to decrease the product capacity of cavity 116. Similarly, a second floor member 126 having a diameter slightly smaller than the diameter of the tub member 108 located in proximity of shoulder portions 120 is insertable into the cavity 116 and is positionable on shoulder portions 120 for increasing the product capacity of cavity 116 over that afforded by use of floor member 124. In this regard, floor member 126 must be dimensioned so as to be maneuverable past shoulder portions 118. Likewise, a third floor member 128 having a diameter slightly smaller than the diameter of tub member 108 located in the proximity of shoulder portions 122 is insertable in the cavity 116 and is positionable on shoulder portions 122 for increasing the product capacity of cavity 116 by an even greater amount. Like member 126, floor member 128 must be dimensioned so as to be maneuverable past shoulder portions 118 and 120.

It is also recognized and anticipated that a single floor member can be fashioned and configured with appropriate peripheral edge portions so as to be maneuverable and positionable within the tub member 108 so as to engage any one of the plurality of shoulder portions 118, 120 and 122. This floor member construction may take on a construction similar to floor member 22, 74, or some other configuration, and it may be necessary to vary the radial length of some of the shoulder portions in order to ensure engagement with the peripheral edge portions associated with such floor member. Still further, the shoulder portions 118, 120 and 122 may be circumferentially offset or staggered similar to the staggered arrangement of shoulder portions 46, 48 and 50 illustrated in FIG. 3, in which case an appropriate floor member may include correspondingly positioned cutouts defining peripheral edge portions similar to the edge portions 96 and 98 illustrated with respect to floor member 74 (FIGS. 11–13) which may be maneuvered and/or rotated within the tub member 108 to both clear certain shoulder portions and rest upon other shoulder portions as previously described with respect to both floor members 22 and 74.

Figure 16:
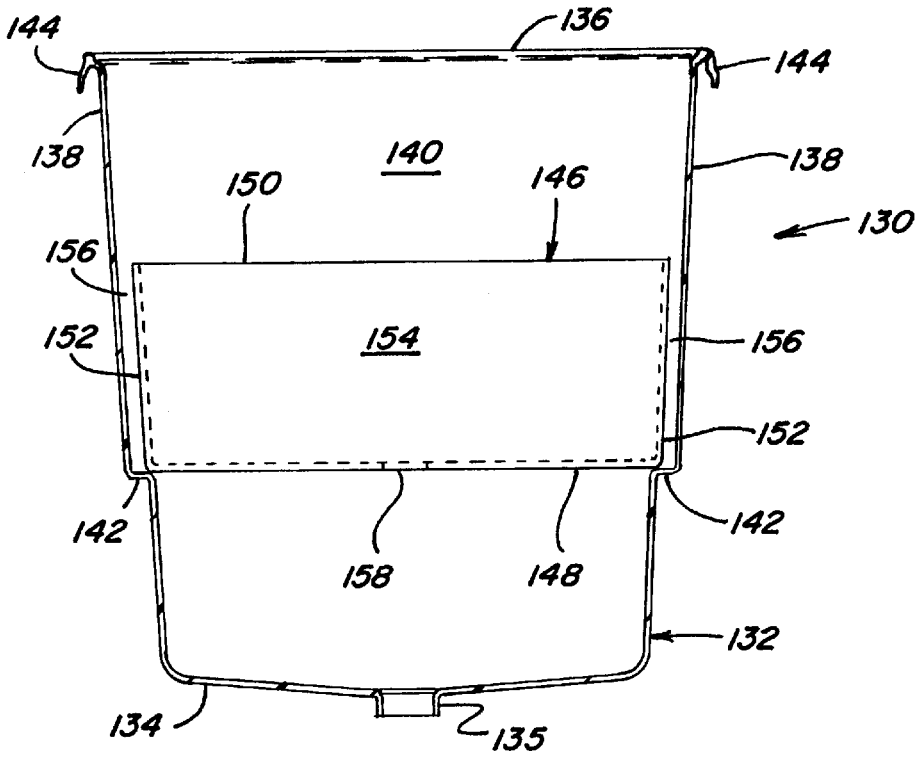
FIG. 16 is a cross-sectional view of another embodiment of a tub member and corresponding product support member having selectable product capacity constructed according to the teachings of the present invention, the product support member being illustrated in one of its two possible operative orientations.
Figure 17:
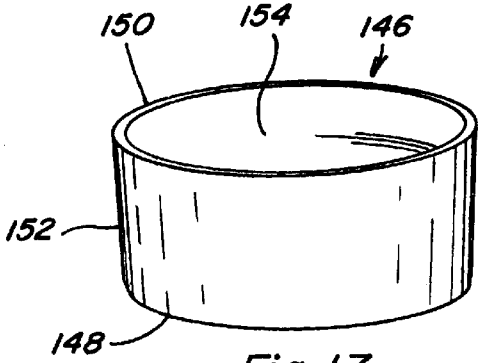
FIG. 17 is a perspective view of the product support member illustrated in FIG. 16.
Figure 18:
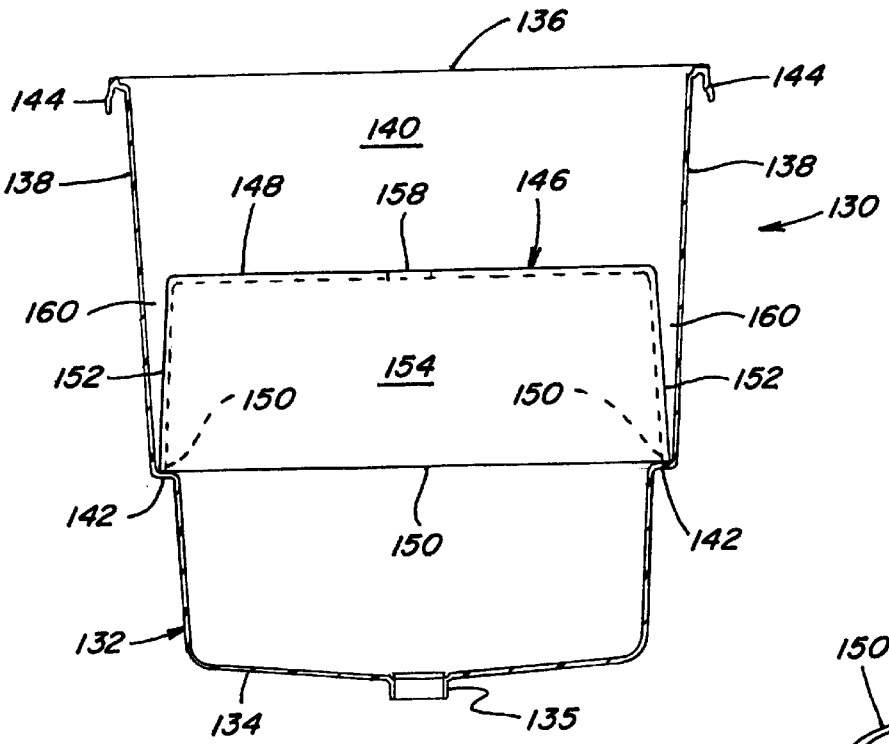
FIG. 18 is a cross-sectional view similar to FIG. 16 showing the product support member of FIGS. 16 and 17 positioned in its second operative orientation.

FIGS. 16, 17 and 18 illustrate still another embodiment 130 of a chilled beverage display container assembly having selectable product capacity adaptable for use in association with an outer body member such as the body member 14 discussed above and illustrated in FIGS. 1 and 8–10. The assembly 130 includes a tub shaped member 132 having a bottom wall portion 134, an opposed open top end portion 136, and a continuous sidewall portion 138 extending therebetween defining an internal cavity 140. The tub member 132 includes at least one inwardly extending shoulder portion 142 located on sidewall portion 138 at an intermediate location between the top and bottom end portions 136 and 134 respectively as best shown in FIGS. 16 and 18. Shoulder portion 142 could include a single shoulder portion extending a sufficient lateral or circumferential distance around the inner portion of tub sidewall 138 so as to provide adequate support for and stability for the product support member 146 when positioned thereon, or such shoulder portion 142 may include a plurality of segmented shoulder portions which are laterally or circumferentially spaced around the inner portion of the tub sidewall 138 at the same intermediate location so as to likewise engage and provide adequate support for the product support member 146 as will be hereinafter explained. The tub member 132 likewise includes an annular downturned flange 144 extending therearound, similar to the annular flange members 40 and 80 previously discussed, for engaging the top peripheral edge of an outer body member such as the body member 14 (FIGS. 1 and 8–10) so as to adequately support the same when the tub member 132 is positioned within an outer body member.

The embodiment 130 likewise includes a product support member 146 as best illustrated in FIG. 17, the support member 140 being substantially cylindrical in shape and including a bottom wall portion 148, an opposed open top end portion 150, and a continuous sidewall portion 152 extending therebetween defining an internal cavity 154 as best shown in FIGS. 16 and 17. In other words, the product support member 146 is barrel-like or tub-like in configuration and such member is adaptable for holding product and ice within its internal cavity 154. The member 146 is shaped and dimensioned so as to be insertably receivable within the tub cavity 140 such that its bottom wall portion 148 engages and rests upon the inwardly extending shoulder portion 142 as shown in FIG. 16. When so positioned as illustrated in FIG. 16, the product support member 146 can be filled with product and ice and the usable product capacity or volume associated with this arrangement will extend from the bottom wall portion 148 of the member 146 to the opposed open top end portion 136 of the tub member 132. In this regard, the sidewall portion 152 of product support member 146 may be substantially cylindrical in shape, or such sidewall may be tapered or otherwise configured so as to substantially conform to the shape or taper associated with the tub sidewall 138. If the sidewall portion 152 of product support member 146 is slightly tapered as illustrated in FIG. 16, the annular space 156 which lies between the product support member sidewall 152 and the tub sidewall 138 (FIG. 16) is such that such space 156 is not sufficiently large enough to allow any products positioned within the cavities 154 and 140 such as bottled or canned soft drink products to enter or otherwise become trapped or lodged therewithin. As best shown in FIG. 16, the bottom wall portion 148 of product support member 146 likewise includes at least one drain opening 158 for conducting any liquid from melting ice which may accumulate in the lower portion of cavity 154 to the lower reservoir portion of the tub member 132 for additional flow and escape through drain opening 135 associated with the tub bottom wall portion 134.

If a smaller product capacity or volume is desired during low sales volume periods, the product support member 146 as illustrated in FIG. 16 can be removed from tub member 132 and such member can be inverted and then repositioned within tub member 132 as illustrated in FIG. 18. In this particular configuration, the upper edge portion of top end portion 150 of the product support member 146 engages and rests upon the shoulder portion(s) 142 and the closed bottom wall portion 148 of member 146 now forms the floor surface portion for supporting products positioned within the tub cavity 140. As can be seen from the arrangement illustrated in FIG. 18, the inner cavity 154 of product support member 146 is now unusable and the available product capacity or volume is considerably smaller as compared to the arrangement illustrated in FIG. 16 since the bottom wall portion 148 of product support member 146 is now positioned at a location intermediate the shoulder portion(s) 142 and the open top end portion 136 of tub member 132. Like the annular space 156 (FIG. 16), the annular space 160 which lies between the product support member sidewall 152 and the tub sidewall 138 is sufficiently small such that products positioned within the tub cavity 140 illustrated in FIG. 18 will be entirely supported by the bottom wall portion 148 and no products will be able to enter or otherwise become trapped or lodged within the annular space 160. If ice is used to chill the products positioned within the cavity 140 as illustrated in FIG. 18, drain opening 158 will again function to conduct any liquid from melting ice which may accumulate in the tub cavity 140 above bottom wall portion 148 to the lower portion of tub member 132 for exit through drain opening 135. The reversible/inverted use of product support member 146 therefore provides a quick and easy way for selecting at least two different product capacities of the tub member 132 depending upon the consumer demand level at any particular point in time, the arrangement illustrated in FIG. 16 being compatible for use during high sales volume periods and the arrangement illustrated in FIG. 18 being compatible for use during lower sales volume periods.

Figure 21:
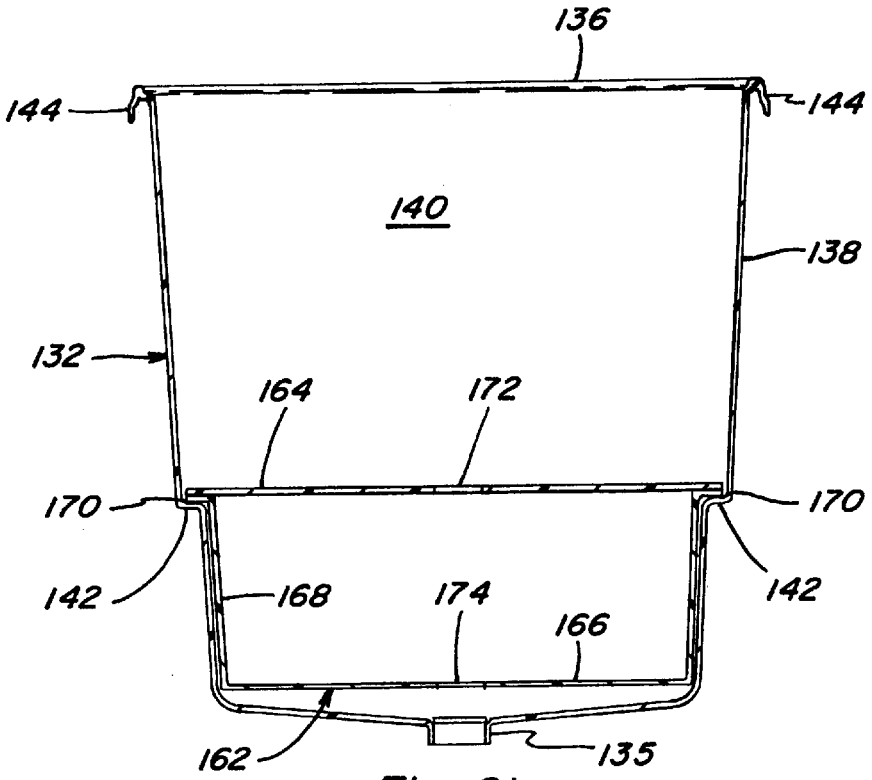
FIG. 21 is a cross-sectional view of the tub member illustrated in FIGS. 16 and 18 showing the product support member of FIGS. 19 and 20 positioned therewithin in one of its two possible operative orientations.
Figure 20:
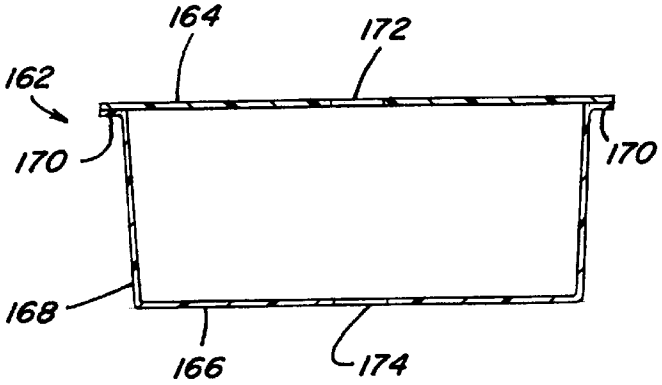
FIG. 20 is a cross-sectional view of the product support member of FIG. 19 taken along line 20—20 of FIG. 19.
Figure 19:
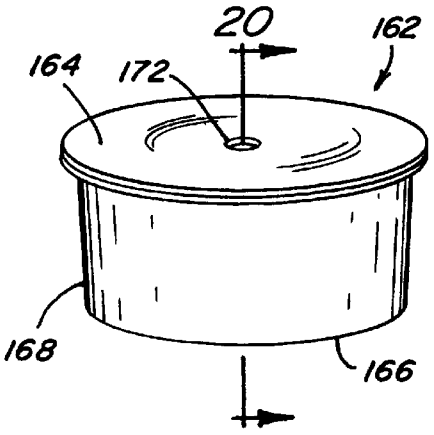
FIG. 19 is a perspective view of another embodiment of the product support member illustrated in FIGS. 16–18.

FIGS. 19, 20, 21 and 22 illustrate an alternative product support member construction 162 which is likewise usable with the tub member 132 described above. The product support member 162 is likewise somewhat cylindrical in shape and includes a substantially closed top wall portion 164, a substantially closed bottom wall portion 166, and a continuous sidewall portion 168 extending therebetween as best shown in FIGS. 19 and 20. The top wall portion 164 overhangs the sidewall portion 168 and forms an overhanging annular lip portion 170 as best illustrated in FIG. 20. Like the product support member 146, the product support member 162 is shaped and dimensioned so as to be insertably positioned within the internal cavity 140 of tub member 132 such that the overhanging lip portion 170 engages shoulder portion(s) 142 as illustrated in FIG. 21. In this particular configuration, the top wall portion 164 of product support member 162 forms the product support floor surface for supporting products positioned within the tub cavity 140. Although the sidewall portion 168 of product support member 162 can likewise be either substantially cylindrical in shape or such sidewall portion can be tapered or otherwise shaped so as to be compatible with the shape or taper associated with the tub sidewall 138, it is important that the overall shape and dimension of the annular sidewall 168 be likewise compatible for being insertably received within the confines of the lower reservoir portion of the tub member 132 as illustrated in FIG. 21.

Like the product support member 146, the member 162 likewise includes drain means for allowing the liquid from any melted ice used in the tub configuration illustrated in FIG. 21 to be carried or conducted to the drain opening 135 associated with the tub bottom wall portion 134. In this particular embodiment, both the top wall portion 164 and the bottom wall portion 166 of member 162 include respective drain openings 172 and 174 for allowing any melted waste water to flow through the member 162 into the lower reservoir portion of tub member 132 for final exit through drain opening 135. In this regard, it is recognized and anticipated that the interior portion of product support member 162 may be substantially hollow, or such interior portion may be substantially closed or filled with any suitable material so long as a passageway or other means exists therewithin for allowing waste water to flow or otherwise percolate through the interior portion of member 162 from drain opening 172 to drain opening 174.

Figure 22:
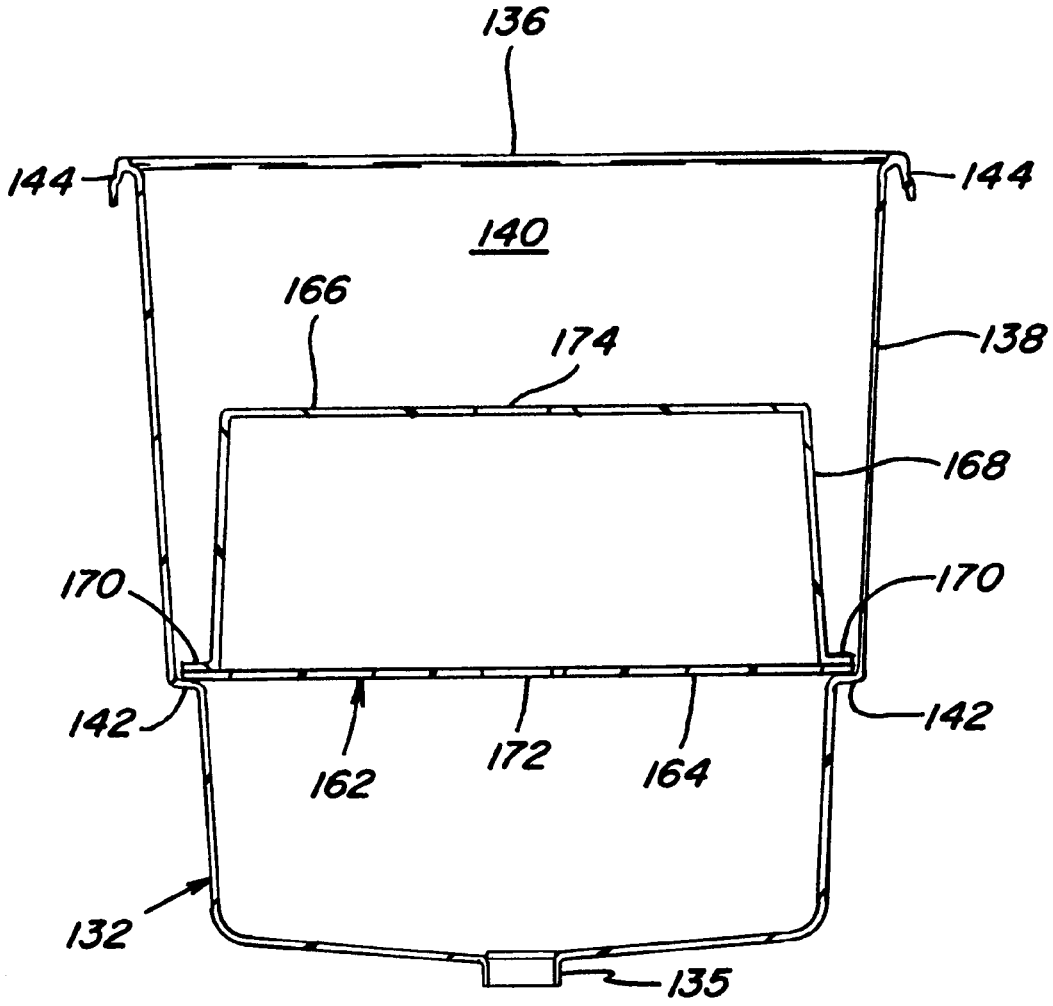
FIG. 22 is a cross-sectional view similar to FIG. 21 showing the product support member of FIGS. 19–21 positioned in its second operative orientation.

Like the product support member 146, the product support member 162 can likewise be removed from the tub member 132 and such member can be invertedly repositioned therewithin as shown in FIG. 22 so as to achieve a smaller product capacity or volume. In the arrangement illustrated in FIG. 22, the outer peripheral edge portion of the top wall portion 164 of product support member 162 which forms the annular lip portion 170 again engages and rests upon the inwardly extending shoulder portion(s) 142 such that bottom wall portion 166 is now located at an elevated position above the wall member 164 at an intermediate location between wall member 164 and the open top end portion 136 of tub member 132. In this particular configuration, product and ice positioned within the tub cavity 140 illustrated in FIG. 22 will rest upon and be supported by the bottom wall portion 166 of product support member 162. As can be seen from a comparison of the available product volume or capacity illustrated in FIGS. 21 and 22, the product volume or capacity associated with the particular arrangement illustrated in FIG. 22 is smaller as compared to the product capacity or volume associated with the arrangement illustrated in FIG. 21. Here again, any waste water from melting ice which may accumulate in the product holding cavity 140 above the wall portion 166 as illustrated in FIG. 22 will flow through drain openings 174 and 172 into the lower reservoir portion of tub member 132 for further exit through drain opening 135. Like product support member 146, the reversibility/invertability of product support member 162 likewise provides a quick and easy means for selecting at least two different product capacity configurations for the tub member 132 depending upon the consumer demand level at any particular point in time. In this regard, it is also recognized that the product support members 146 and 162 can be totally removed from the tub member 132 thereby even further increasing the product capacity of tub cavity 140 over that afforded by use of the members 146 and 162 illustrated in FIGS. 16 and 21.

Although the function, operation and use of the product support members 146 and 162 have been described in conjunction with tub member 132 having shoulder portion (s) 142 located at only one elevated location intermediate the top and bottom portions thereof, it is anticipated and recognized that the tub member 132 could be configured and dimensioned so as to include a plurality of inwardly extending shoulder portions located adjacent the inner surface of tub cavity 140 at vertically spaced locations therewithin intermediate the top and bottom end portions thereof. In this situation, the inwardly extending shoulder portion(s) 142 as well as the product support members 146 and 162 can be shaped and dimensioned such that the respective product support members 146 and 162 will engage each plurality of shoulder portions at each elevated position within the cavity 140 in either one of their two invertable or reversible orientations. Such a configuration could be somewhat similar to the tub member and shoulder configuration illustrated in FIGS. 1–10 wherein, for example, the top wall portion 164 of member 162 may be configured substantially similar to floor member 22 and the plurality of vertically spaced shoulder portions associated with tub cavity 140 may take on a configuration somewhat similar to the shoulder portions 46, 48 and 50 previously discussed. Other orientations and configurations of both the shoulder portions as well as the product support members associated with the embodiments illustrated in FIGS. 16–22 are likewise possible to effect the proper positioning of such product support members, such as the members 146 and 162, relative to the corresponding shoulder portions, such as the shoulder portion(s) 142.

Figure 25:
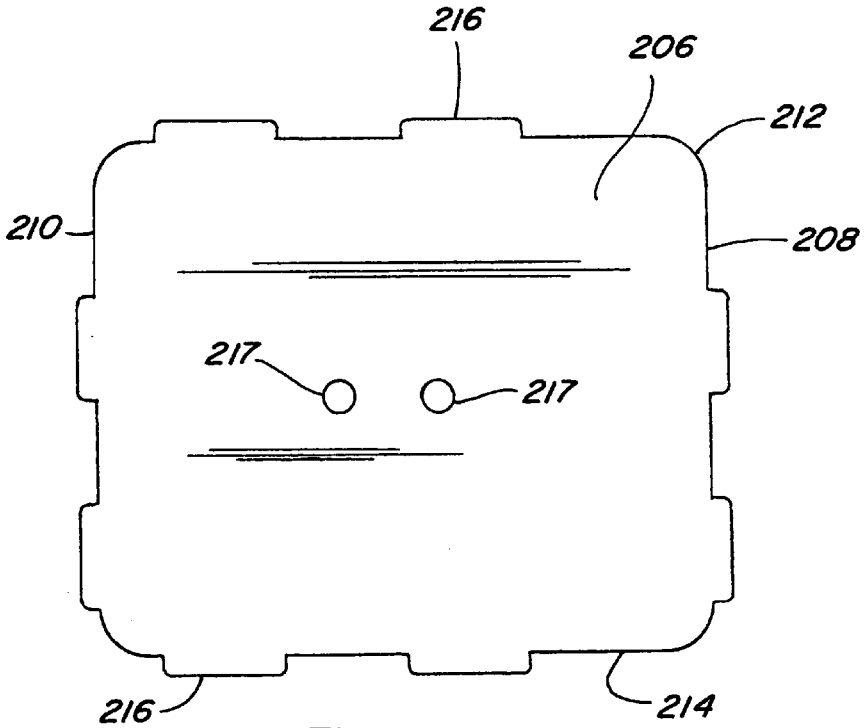
FIG. 25 is a top plan view of the corresponding product support floor member used in conjunction with the tub member of FIGS. 23 and 24.
Figure 23:
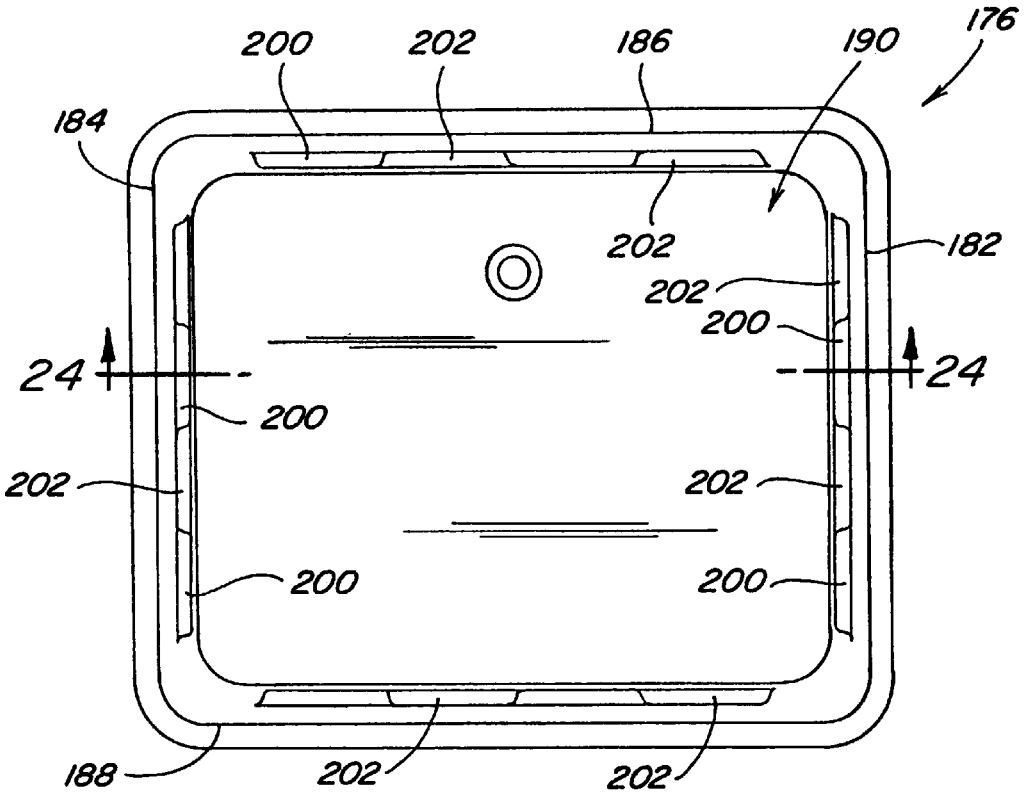
FIG. 23 is a top plan view of another embodiment of a tub member constructed according to the teachings of the present invention.
Figure 24:
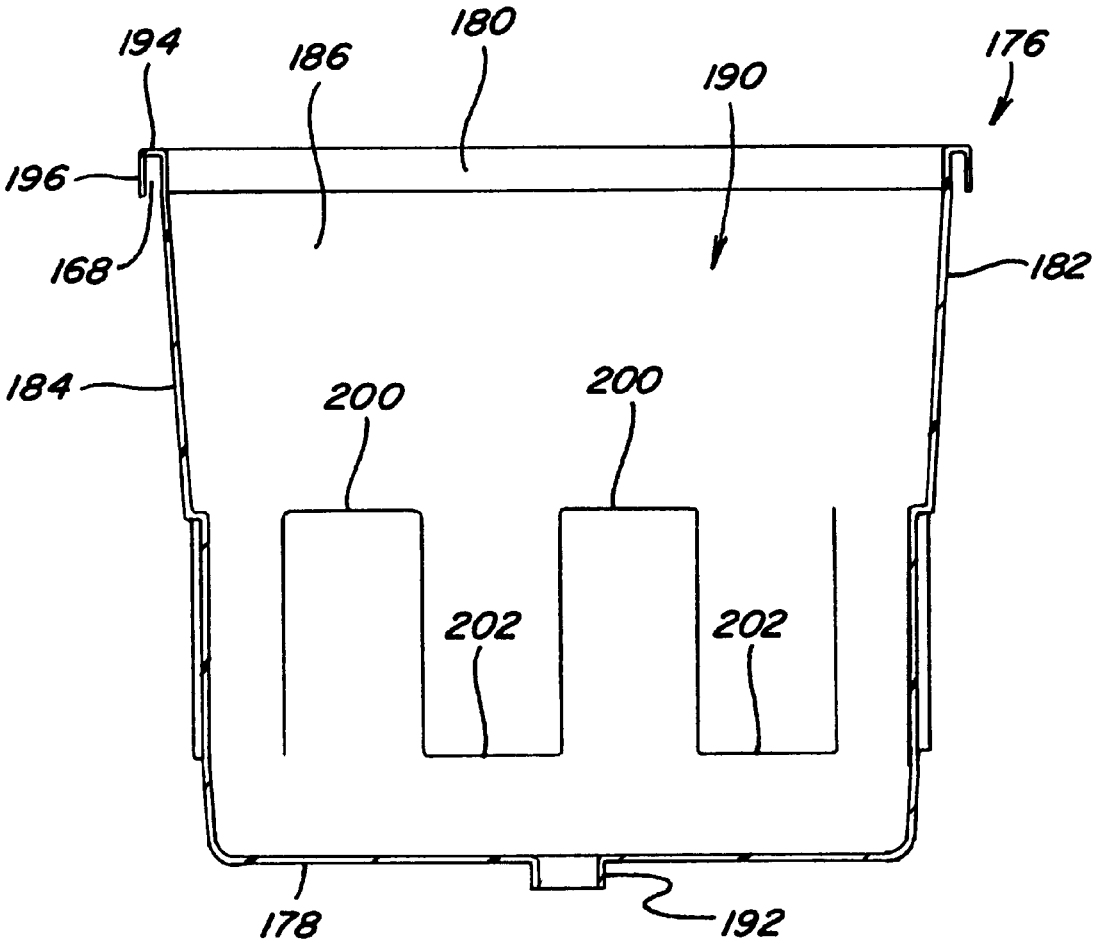
FIG. 24 is cross-sectional view of the tub member of FIG. 23 taken along line 24—24 of FIG. 23.

FIGS. 23–25 illustrate one adaptation of the present invention described with respect to embodiment 10 illustrated in FIGS. 1–10 to either a square or rectangular shaped product merchandising unit. More particularly, FIGS. 23 and 24 identify a square or rectangular shaped tub member 176 which includes a lower bottom wall portion 178, an opposite open upper end portion 180, opposed sidewall portions 182, 184, 186 and 188 defining therebetween an internal cavity 190, and a central drain opening 192 located in bottom wall portion 178 for conducting any liquid from melting ice which may accumulate in the lower portion of cavity 190 to suitable receiving means. The upper end portion 180 of tub member 176 likewise includes a top rim portion 194 and a downturned flange portion 196 extending therearound as best shown in FIG. 24, the portions 194 and 196 forming an outer groove 198 adapted to receive the upper edge portion of a similarly shaped outer body member as previously explained with respect to tub member 20 and body member 14 (FIGS. 1 and 3). The tub member 176 is shaped and dimensioned so as to fit within a similarly shaped body member and is suspended therein from the top edge portion thereof by the rim portions 194 and 196 as previously explained.

Similar to the configuration of tub member 20, the opposed side wall portions of the tub member 176 each include a plurality of generally planar upwardly facing shoulder portions or steps such as the shoulder portions 200 and 202 located adjacent the inner surface of each respective sidewall portion at spaced, offset locations around the internal cavity 190 as best shown in FIGS. 23 and 24. More particularly, in the particular embodiment illustrated in FIGS. 23 and 24, each respective side wall portion 182, 184, 186 and 188 includes two shoulder portions 200 and two shoulder portions 202, each group of shoulder portions 200 and 202 being offset respectively both laterally and in elevation. In this particular embodiment, the shoulder portions 200 and 202 associated with opposed sidewall portions 182 and 184 are positioned and located in diametrically opposed relationship to each other and the shoulder portions 200 and 202 associated with opposed sidewall portions 186 and 188 are likewise similarly positioned and located as best shown in FIG. 23.

FIG. 25 illustrates the corresponding removably adjustable floor member 204 which would be utilized with the tub member 176 for varying the product holding capacity thereof. The floor member 204 is sized and dimensioned so as to be compatible with the square or rectangle configuration of the tub member 176 and includes a substantially flat planar member 206 having opposed sidewall portions 208, 210, 212 and 214. The outer peripheral edge portion of each opposed sidewall portions 208, 210, 212 and 214 includes a plurality of spaced ears or peripheral edge portions 216 which extend outwardly therefrom as shown in FIG. 25. The peripheral edge portions 216 associated with the respective opposed sidewall portions of floor member 204 are likewise positioned and located in diametrically opposed relationship to each other and each extends outwardly therefrom a sufficient distance so as to mate with and rest upon the shoulder portions 200 when the floor member 204 is so positioned within the tub member 176 in a first orientation. When the floor member 204 is positioned within the tub member 176 such that the peripheral floor edge portions 216 are engaged with the shoulder portions 200, the floor member 176 will be located at substantially the same vertical location within the tub member 176 as shoulder portions 200 as best shown in FIG. 24. If the floor member 176 is rotated in a horizontal plane 180° from its first orientation, the peripheral floor edge portions 216 will be positioned and located so as to engage the shoulder portions 202. In this second orientation, the floor member 204 will be located substantially closer to the bottom wall portion 178 of tub member 176 at substantially the same vertical location as shoulder portions 202. Use of the present floor member 204 in one of its two above-described orientations therefore provides a quick and easy way for selecting at least two different product capacities for the tub member 176. In this regard, it is also anticipated and recognized that any plurality of shoulder portions such as the shoulder portions 200 and 202 can be incorporated into the respective sidewalls of tub member 176 and a corresponding number of peripheral floor edge portions 216 can be positioned and located along the outer peripheral edge portion of the sidewall portions of floor member 204 so as to selectively adjustably position the floor member 204 within tub member 176 at any one of a plurality of different vertical locations therewithin to even further vary the product holding capacity thereof. Floor member 204 also includes a pair of drain openings 217 for allowing any melted waste water to flow through the member 204 into the lower portion of tub member 176 for exit through drain opening 192.

Figure 27:
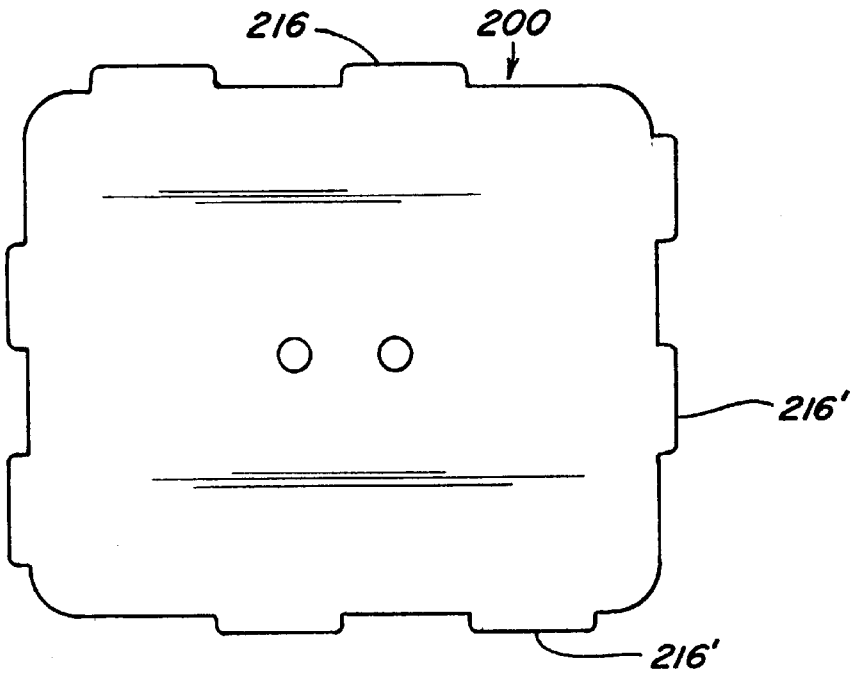
FIGS. 26 and 27 are top plan views of still another embodiment of a tub member and corresponding product support floor member similar to FIGS. 23 and 25.
Figure 26:
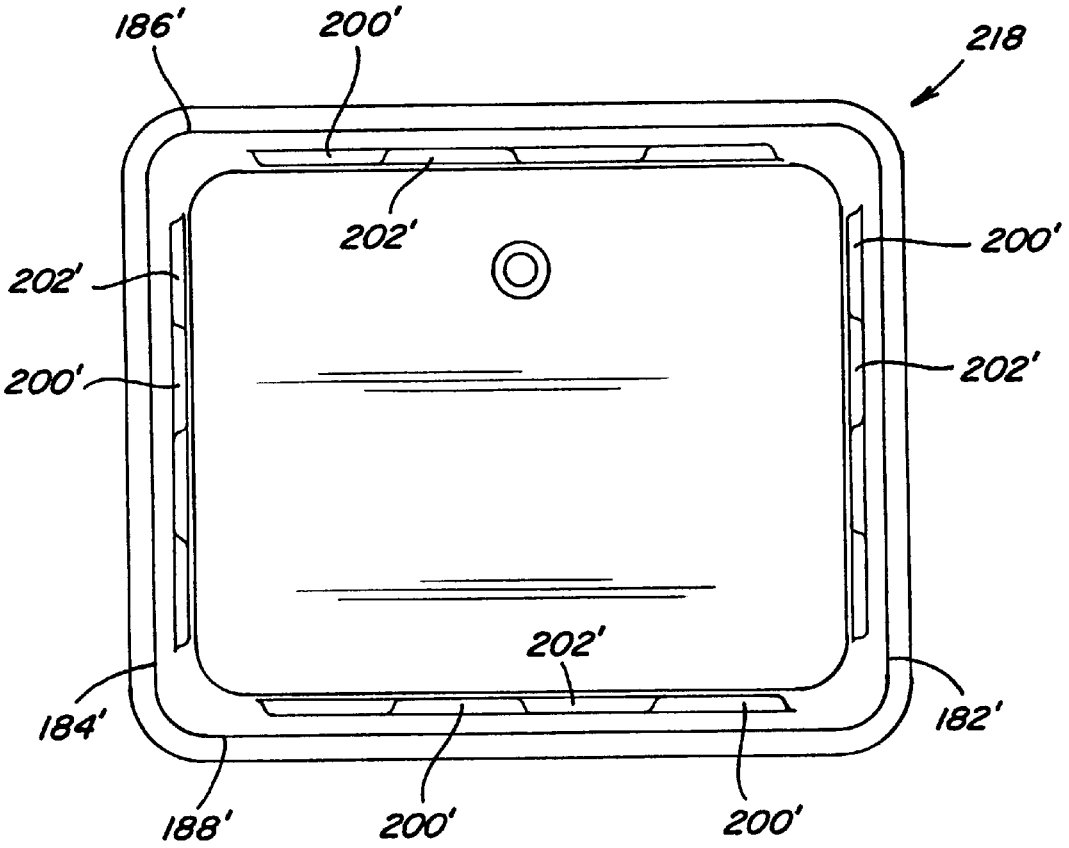

FIGS. 26 and 27 illustrate an alternative construction for both the tub member 176 and the product support floor member 204 illustrated in FIGS. 23 and 25. More particularly, the tub member 218 illustrated in FIG. 26 is substantially similar to tub member 176 (FIG. 23) except for the positioning and location of the shoulder portions 200' and 202'. Unlike the diametrically opposed positioning of shoulder portions 200 and 202 in the construction of tub member 176, the positioning and location of the shoulder portions 200' and 202' associated with the respective opposed sidewall portions of tub member 218 are not diametrically opposed to each other, but instead, are offset and staggered as illustrated in FIG. 26. For example, the shoulder portions 200' and 202' associated with sidewall portion 188' are offset and staggered to the right as compared to the positioning and location of the shoulder portions 200' and 202' associated with opposed sidewall portion 186'. This same relationship is true of the shoulder portions 200' and 202' associated with opposed sidewall portions 182' and 184'. In similar fashion, the peripheral edge portions 216' associated with the product support floor member 220 illustrated in FIG. 27 are likewise positioned and located in staggered relationship with respect to the respective opposed sidewall portions of member 220. Like floor member 204, when the product support floor member 220 is positioned within tub member 218 in a first orientation, the peripheral floor edge portions 216' will mate with and rest upon the higher elevated shoulder portions 200'. In order for the peripheral floor edge portions 216' to engage and rest upon the lower elevated shoulder portions 202', the floor member 220 must be rotated or flipped in the vertical plane 180° from its first orientation. In this particular embodiment, the invertability of the product support floor member 220, like floor member 204, likewise provides a quick and easy means for selecting at least two different product capacity configurations for the tub member 218, the only difference being the manner in which the floor member 220 is maneuvered from its first orientation to its second orientation as compared to the maneuvering required to accomplish the same objective with floor member 204. Like the members 176 and 204, additional shoulder portions and peripheral floor edge portions may be strategically added to tub member 218 and corresponding floor member 220 to achieve still additional pluralities of different locations within the internal cavity of tub member 218 at which the floor member 220 could be selectively positioned for further varying the product holding capacity thereof.

Figure 28:
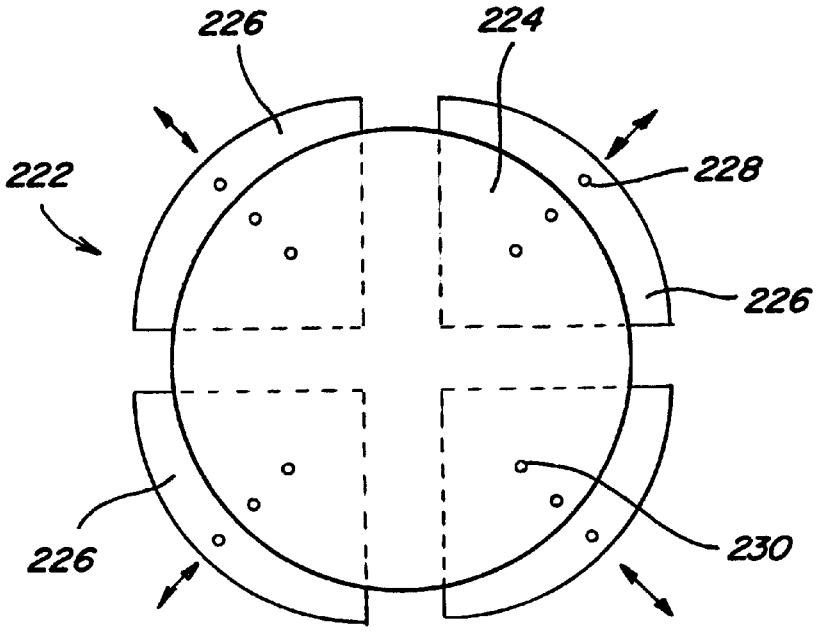
FIG. 28 is a top plan view of still another embodiment of a product support member adaptable for use with the tub members illustrated in FIGS. 3–6, 12 and 15.

FIG. 28 illustrates still another embodiment of an adjustable product support member 222 which can likewise be utilized in conjunction with a tub member having a plurality of inwardly extending shoulder portions located at circumferentially spaced locations around the inner cavity wall thereof at different respective locations between the tip and bottom end portions thereof such as the tub members 20, 72 and 108 illustrated in FIGS. 3–6, 12 and 15. The product support member 222 includes a substantially circular base member 224 and a plurality of slidably positionable arcuate portions 226, the arcuate portions 226 being slidably movable in a radial direction as illustrated in FIG. 28 so as to adjust and expand the outer periphery of the member 224 in a radial direction. Each arcuate portion 226 includes a plurality of openings 228 which are positioned and located so as to lie in registration with at least some of a plurality of corresponding openings 230 formed through the base member 224 at various locations thereon as illustrated in FIG. 28. As each arcuate portion 226 is radially moved outwardly relative to the base member 224, the outside periphery of that portion of base member 224 is radially expanded and at least one pair of respective openings 228 and 230 will lie in registration with each other at each of the radially expandable positions achievable by the arcuate portions 226. In this regard, any number of respective openings 228 and 230 can be utilized in association with each arcuate portion 226, the spacing between the respective openings 228 and 230 determining the incremental radial movement of each arcuate portion 226 relative to the base member 224. Also, importantly, any number of arcuate portions 226 can be circumferentially spaced around the base member 224, and the length of the particular arc associated with each respective arcuate portion 226 can likewise be varied to accommodate the lateral spacing between adjacent shoulder portions both laterally and in elevation.

For example, for use in combination with tub member 72 illustrated in FIG. 12, the product support member 222 will operate as follows. The diameter of the circular base member 224 is dimensioned such that when the respective arcuate portions 226 are fully radially retracted, the outermost peripheral edge portions thereof do not extend beyond the outer periphery of the member 224. In this configuration, the outermost peripheral edge portions of the member 224 will cooperatively engage shoulder portions 92 within tub member 72 so as to support the product support member 222 at such location within the tub cavity 84. To engage the shoulder portions 90 associated with tub member 72, the arcuate portions 226 are radially expanded outwardly an appropriate amount such that the outer peripheral edge portions of the arcuate portions 226 will cooperatively engage shoulder portions 90 so as to enable the product support member 222 to be positioned and supported at such location within the tub cavity 84. In like manner, the arcuate portions 226 are further radially expanded so as to cooperatively engage the shoulder portions 88 thereby enabling the product support member 222 to be positioned and supported at this location within tub cavity 84. The arcuate portions 226 are held in their respective radially expanded positions relative to base member 224 by means of any suitable fastener member (not shown) or other holding means which can be positioned through any one or more respective pairs of openings 228 and 230. Depending upon the shape and location of the respective shoulder portions associated with any particular tub member, it may be necessary to radially expand some arcuate portions 226 and radially retract other arcuate portions 226 in order to support the product support member 222 at any particular location within a particular tub member. This will be particularly true in the case of tub member 20 wherein the shoulder portions 46, 48 and 50 are located at circumferentially spaced, offset locations around internal cavity 30 as best shown in FIGS. 1 and 3. In this particular situation, the number and arc length associated with the respective arcuate portions 226 must be compatible with the size and spacing associated with the shoulder portions 46, 48 and 50 such that at least some of the arcuate portions 226 can be positioned to cooperatively engage at least some of the shoulder portions 46, 48 and 50 at their respective vertically spaced locations within the tub member 20. Although the product support member 222 has been described as being substantially circular in shape for use with a substantially cylindrical tub member, it is also recognized and anticipated that the support member 222 as well as the expandable members 226 can take on any shape including a square, rectangular and triangular configuration so as to be compatible with the shape and configuration of the tub member into which it will be positioned.

Figure 29:
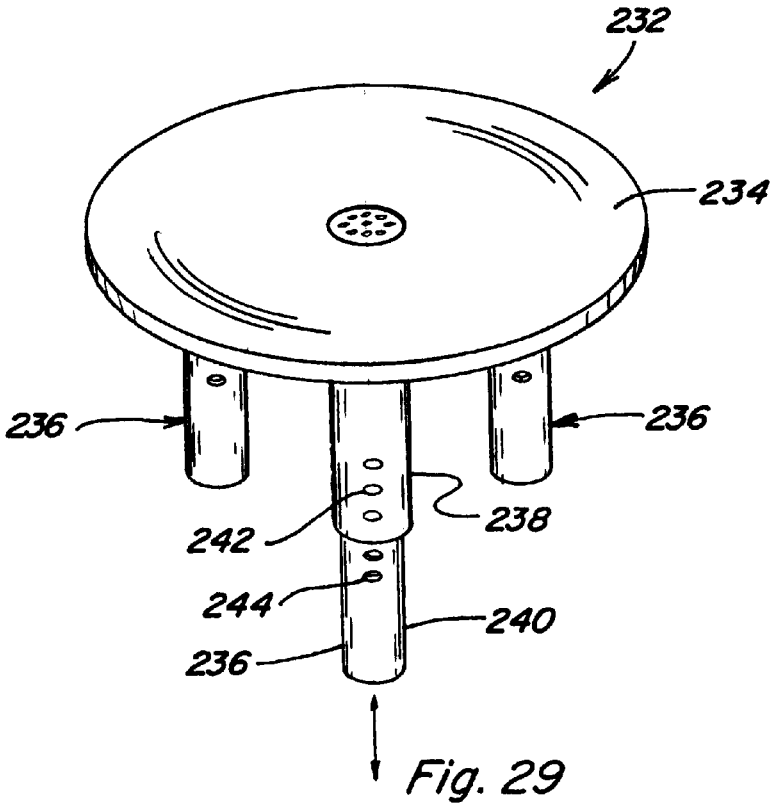
FIG. 29 is a perspective view of still a further embodiment of a product support member constructed with telescoping leg members to provide selective adjustment for varying the product holding capacity of the tub member into which such support member is positioned.

FIG. 29 illustrates still another embodiment of a product support member 232 which can be utilized with a wide variety of tub members to vary the product capacity thereof. More particularly, the product support member 232 includes a substantially planar floor portion 234 having a plurality of telescoping leg members 236 attached thereto, each leg member 236 being selectively adjustable to position the supporting floor portion 234 at any intermediate elevation between the top and bottom end portions of any particular tub member into which it is positioned. In this regard, each telescoping portion 238 and 240 of each respective leg member 236 includes a plurality of aligned and opposed openings 242 and 244 respectively, at least one pair of opposed openings 242 lying in registration with at least one pair of opposed openings 244 at any one of the possible selected positions achievable with the telescoping leg portions 238 and 240. Once the proper length of each respective leg member 236 is determined and set for any particular application, any suitable pin member, or other holding mechanism may be slidably inserted through the aligned openings 242 and 244 to hold and/or lock the respective leg members 236 at a predetermined length so as to position the floor portion 234 at a selected location within the tub member. Here again, although the product support member 232 is illustrated as having a substantially circular floor portion 234, it is recognized and anticipated that the floor portion 234 can take on a wide variety of other shapes and configurations as discussed above so long as it is dimensioned and configured for compatible insertion within the internal cavity of the tub member or other receptacle into which it will be utilized. The telescoping leg members 236 therefore allow the product support member 232 to be supported and maintained at a wide variety of various selected locations within any particular tub member so as to vary the product holding capacity of such tub member.

In operation, any of the above-described embodiments 10, 70, 106 and 130 including embodiments 162, 176, 204, 218, 220, 222 and 232 can be easily and conveniently adapted and/or used to achieve a desired reduced product display area for service during lower consumer traffic periods by merely adjusting the product support floor member to the desired location within the tub member and thereafter resting, attaching or cooperatively engaging such floor member with the shoulder portions or other members or portions associated with the tub member for supporting the same at the desired elevation therein. The reduced product display area can then be filled as desired with articles for sale and ice to make an attractive display. During use, as the ice melts, the melt water will collect in the unused display area or reservoir portion of the tub member located beneath the product support structure such that consumers can reach into the display unit and obtain an article without immersing their hands in water. To adapt the present devices for periods of higher consumer demand, the product support structures can be merely repositioned and engaged with the same or another plurality of shoulder portions or other members provided for supporting such floor structure in the device at a lower elevation within the tub member to enlarge the display area or product capacity as desired.

Thus, there has been shown and described several preferred embodiments of a product merchandising unit having a selectable product capacity, which embodiments fulfill all of the objects and advantages sough therefor. Many changes, modifications, variations and other uses and applications of the present product merchandising units will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A container assembly having a selectable product capacity comprising:

a receptacle having an internal cavity adaptable for holding products positioned therein, said receptacle including a first end portion having an opening communicating with said internal cavity, an opposed second end portion forming the bottom wall of said cavity, and a sidewall portion extending around said cavity between said first and second receptacle end portions;

a floor member selectably positionable within the internal cavity of said receptacle at at least two spaced locations therewithin intermediate said first and second receptacle end portions, said floor member being adaptable for holding and supporting products positioned thereon and being further sized and shaped so as to be maneuverable into a substantially flat supportive position at each of said at least two spaced locations within said receptacle cavity, and at least one member for supporting said floor member at each of said at least two spaced locations, said at least one member including a plurality of shoulder portions positioned at each of said at least two spaced locations within said receptacle cavity, the shoulder portions located at each of said at least two spaced locations being respectively sized and shaped so as to engage peripheral edge portions of said floor member when said floor member is maneuvered into a substantially flat supportive position adjacent each of said plurality of spaced shoulder portions, the plurality of shoulder portions located at a first of said at least two spaced locations within said receptacle cavity being laterally offset with respect to the plurality of shoulder portions located at a second of said at least two spaced locations within said receptacle cavity.

2. The container assembly defined in claim 1 wherein the plurality of shoulder portions located at a first of said at least two spaced locations within said receptacle cavity are vertically aligned with respect to the plurality of shoulder portions located at a second of said at least two spaced locations within said receptacle cavity.

3. The container assembly defined in claim 1 wherein said floor member and at least some of said shoulder portions include portions cooperatively engageable with each other to prevent relative movement therebetween when said floor member is supportively positioned on said shoulder portions.

4. A product merchandising unit for holding and displaying products comprising a tub member having opposed top and bottom end portions and a sidewall portion extending therebetween defining a cavity for holding products positioned therein, said top end portion being open and providing access to said cavity, the sidewall portion of said tub member including a plurality of shoulder portions located at spaced lateral locations around said tub cavity at a plurality of vertically spaced locations therewithin, and a floor member selectably positionable within said tub cavity at locations corresponding to each of said vertically spaced locations for holding and supporting products positioned thereon, said floor member including a first plurality of spaced peripheral edge portions positioned and located so as to mate with and rest upon respective shoulder portions at each of said plurality of vertically spaced locations within said tub cavity, said floor member including a second plurality of spaced peripheral edge portions enabling said floor member to be maneuvered into each of said plurality of vertically spaced locations, said second plurality of spaced peripheral edge portions being located at a different distance from the tub sidewall as compared to said first plurality of spaced peripheral edge portions when said floor member is positioned within said tub cavity.

5. The product merchandising unit defined in claim 4 wherein said first plurality of spaced peripheral edge portions are defined by a plurality of peripheral projections extending outwardly away from said second plurality of spaced peripheral edge portions.

6. The product merchandising unit defined in claim 4 wherein said first plurality of spaced peripheral edge portions are defined by a plurality of cutouts extending inwardly away from said second plurality of spaced peripheral edge portions.

7. The product merchandising unit defined in claim 4 wherein said tub member is substantially cylindrical in shape and said floor member is substantially circular in shape, said first plurality of spaced peripheral floor edge portions extending radially outwardly from the center of said floor member a radial distance which is greater than the radial distance associated with said second plurality of spaced peripheral edge portions.

8. The product merchandising unit defined in claim 4 wherein said tub member is substantially cylindrical in shape and said floor member is substantially circular in shape, said first plurality of spaced peripheral floor edge portions extending radially outwardly from the center of said floor member a radial distance which is less than the radial distance associated with said second plurality of spaced peripheral edge portions.

9. The product merchandising unit defined in claim 6 wherein the plurality of shoulder portions located at at least one of said vertically spaced locations are laterally offset relative to the plurality of shoulder portions located at at least one other vertical location.

10. The product merchandising unit defined in claim 6 wherein the plurality of shoulder portions located at at least one of said plurality of vertically spaced locations are vertically aligned with the plurality of shoulder portions located at at least one other vertical location.

11. The product merchandising unit defined in claim 6 wherein said tub member is adaptable for holding chilled products and ice and includes means for draining any accumulated water formed therein.

12. The product merchandising unit defined in claim 11 wherein said floor member includes means to allow the passage of water from above said floor member to an area located below said floor member.

13. A container assembly having selectable capacity for holding and displaying chilled products comprising:

a tub member having opposed top and bottom end portions and a sidewall extending therebetween defining an internal cavity adapted for receiving and holding a first quantity of product and ice positioned therein, said top end portion being open and providing access to said internal cavity, a floor member positionable in said internal cavity and cooperatively engageable with the sidewall of said tub member at a plurality of locations intermediate the top and bottom end portions thereof for supporting a second quantity of product and ice in said internal cavity in spaced relation to the bottom end portion of said tub member, said tub sidewall and said floor member including portions engageable to prevent relative movement therebetween when cooperatively engaged.

14. The container assembly defined in claim 13 wherein said tub sidewall includes at least one shoulder portion cooperatively engageable with said floor member at each of said intermediate locations.

15. The container assembly defined in claim 14 wherein said at least one shoulder portion is integrally formed with said tub sidewall.

16. The container assembly defined in claim 13 wherein said tub sidewall includes a plurality of members at spaced locations around said internal cavity cooperatively engageable with said floor member at each of said intermediate locations.

17. A container assembly adaptable for holding and displaying products comprising a tub member having opposed top and bottom end portions and a sidewall portion extending therebetween defining a cavity for holding products positioned therein, said top end portion being open and providing access to said tub cavity, the sidewall portion of said tub member including a plurality of longitudinally extending rib members located at spaced locations around said tub cavity, each of said longitudinally extending rib members including a plurality of longitudinally spaced shoulder portions, and a floor member selectably positionable within said tub cavity at locations corresponding to each of said longitudinally spaced shoulder portions for holding and supporting products positioned thereon, said floor member including a plurality of peripheral edge portions, said plurality of peripheral floor edge portions being positioned and located such that at least some of said peripheral floor edge portions will mate with and rest upon the shoulder portions located at each longitudinally spaced location on said plurality of rib members.

18. The container assembly defined in claim 13 wherein at least some of said plurality of peripheral floor edge portions are defined by a plurality of cutouts located along the outer edge portion of said floor member, the peripheral edge portions defined by said cutouts being located at a different distance from said tub sidewall as compared to said other peripheral floor edge portions when said floor member is positioned within said tub cavity.

19. The container assembly defined in claim 18 wherein said tub member is substantially cylindrical in shape and said floor member is substantially circular in shape, said plurality of peripheral floor edge portions defined by said plurality of cutouts extending radially outwardly from the center of said floor member a radial distance which is less than the radial distance associated with said other plurality of peripheral floor edge portions.

20. The container assembly defined in claim 18 wherein said plurality of cutouts includes a first plurality of cutouts and a second plurality of cutouts, the peripheral floor edge portions defined by said first plurality of cutouts being located at a first distance offset from said other peripheral floor edge portions, and the peripheral floor edge portions defined by said second plurality of cutouts being located at a second distance offset from said other peripheral floor edge portions.

21. The container assembly defined in claim 17 wherein said tub member is adaptable for holding chilled products and ice and includes means for draining any accumulated water formed therein.

22. The container assembly defined in claim 21 wherein said floor member includes means to allow the passage of water from above said floor member to an area located below said floor member.

23. The container assembly defined in claim 22 wherein said floor member includes a buoyant portion capable of supporting said floor member and a quantity of chilled products and ice on a liquid contained in the tub cavity below said floor member, said buoyant portion being further capable of moving upwardly within said tub cavity as the ice melts.

24. The container assembly defined in claim 23 wherein said plurality of longitudinally extending rib members guide and maintain said floor member in a substantially flat operative position as it travels from one plurality of longitudinally spaced shoulder portions to another plurality of longitudinally spaced shoulder portions.

25. A container assembly having a selectable product capacity comprising a tub member having opposed top and bottom end portions and a sidewall portion extending therebetween defining a cavity for holding and displaying products positioned therein, said top end portion being open and providing access to said tub cavity, a product support member positionable within said tub cavity at at least one location therewithin intermediate the top and bottom end portions thereof, said product support member being selectively positionable at said at least one location within said tub cavity in any one of two different orientations, and at least one member for supporting said product support member in each of its two different orientations at said at least one intermediate tub cavity location, said product support member defining a first product capacity within said tub cavity when positioned at said at least one intermediate tub cavity location in one of its two different orientations, and said product support member defining a second product capacity within said tub cavity when positioned at said at least one intermediate location in the other of its two different orientations.

26. The container assembly defined in claim 25 wherein said at least one member for supporting said product support member in any one of its two different orientations at said at least one intermediate location within said tub cavity includes at least one shoulder portion, said at least one shoulder portion being sized and shaped so as to engage at least a portion of said product support member when said product support member is positioned in each of its two different orientations.

27. The container assembly defined in claim 25 wherein said product support member is tub-shaped in construction and includes a closed bottom wall portion, an open top end portion, and a sidewall extending therebetween defining a cavity therewithin, said closed bottom wall portion having an interior surface within the product support member cavity and an exterior surface, the interior surface of said product support member bottom wall defining the product support floor surface for holding and supporting products positioned within said tub cavity when said product support member is positioned within said tub cavity in one of its two different orientations, and the exterior surface of said product support member bottom wall defining the product support floor surface for holding and supporting products positioned within said tub cavity when said product support member is positioned within said tub cavity in the other of its two different orientations, the product support floor surface defined by the interior surface of said product support member bottom wall being located at a different intermediate location within said tub cavity as compared to the product support floor surface defined by the exterior surface of said product support member bottom wall.

28. The container assembly defined in claim 27 wherein the closed bottom wall portion of said product support member includes means for draining accumulated waste water formed within said tub cavity.

29. The container assembly defined in claim 25 wherein said product support member includes opposed top and bottom wall portions and a sidewall portion extending therebetween, the top wall portion of said product support member defining the product support floor surface for holding and supporting products positioned within said tub cavity when said product support member is positioned within said tub cavity in one of its two different orientations, and the bottom wall portion of said product support member defining the product support floor surface for holding and supporting products positioned within said tub cavity when said product support member is positioned within said tub cavity in the other of its two different orientations, the product support floor surface defined by the top wall portion of said product support member being located at a different intermediate location within said tub cavity as compared to the product support floor surface defined by the bottom wall portion of said product support member.

30. The container assembly defined in claim 29 wherein the top wall portion of said product support member overhangs the sidewall portion thereof forming a lip therearound.

31. The container assembly defined in claim 29 wherein the top and bottom wall portions of said product support member include means for draining accumulated waste water formed within said tub cavity.

32. A product merchandising unit for holding and displaying products comprising a tub member having opposed top and bottom end portions and a sidewall portion extending therebetween defining a cavity for holding products positioned therein, said top end portion being open and providing access to said cavity, the sidewall portion of said tub member including a plurality of shoulder portions located at spaced lateral locations around said tub cavity at a plurality of vertically spaced locations therewithin, and a floor member selectively positionable within said tub cavity at locations corresponding to each of said vertically spaced locations for holding and support products positioned thereon, said floor member including a plurality of portions which are selectively movable such that at least some of the said selectively movable portions are positionable so as to rest upon at least some of said shoulder portions at each of said plurality of vertically spaced locations within said tub cavity.

33. The product merchandising unit defined in claim 32 wherein said floor member includes means to allow the passage of water from above said floor member to an area located below said floor member.

34. A product merchandising unit for holding and displaying products comprising a tub member having opposed top and bottom end portions and a sidewall portion extending therebetween defining a cavity for holding products positioned therein, said top end portion being open and providing access to said cavity, and a floor member selectably positionable within said tub cavity at any one of a plurality of different locations intermediate the top and bottom portions thereof for holding and supporting products positioned thereon, said floor member including a plurality of leg members, each of said leg members being selectively adjustable so as to vary the length thereof, said floor member being positionable at any one of the plurality of different locations within said tub cavity by selecting and adjusting each of said leg members to a particular corresponding length.

35. The product merchandising unit defined in claim 34 wherein said leg members are telescopingly adjustable, each of said leg members including means for holding said leg members at any one of a plurality of selected lengths.

36. The product merchandising display unit defined in claim 34 wherein said floor member includes means to allow the passage of water from above said floor member to an area located below said floor member.

* * * * *

UNITED STATES PATENT AND TRADEMARK OFFICE

CERTIFICATE OF CORRECTION

PATENT NO. : 5,910,162
DATED : June 8, 1999
INVENTOR(S) : Harbour, et. al.

It is certified that error appears in the above-indentified patent and that said Letters Patent is hereby corrected as shown below:

Column 13, line 39, --1 14-- should be "114".

Column 13, line 43, --1 16-- should be "116".

Signed and Sealed this

Sixteenth Day of November, 1999

*Attest:*

Q. TODD DICKINSON

*Attesting Officer*

*Acting Commissioner of Patents and Trademarks*